US010813845B1

(12) United States Patent
Juras

(10) Patent No.: US 10,813,845 B1
(45) Date of Patent: Oct. 27, 2020

(54) ENTERAL FEEDING VESTPACK FOR CHILDREN

(71) Applicant: Megan Diane Juras, Dutton, MT (US)

(72) Inventor: Megan Diane Juras, Dutton, MT (US)

( * ) Notice: Subject to any disclaimer, the term of this patent is extended or adjusted under 35 U.S.C. 154(b) by 135 days.

(21) Appl. No.: 16/146,790

(22) Filed: Sep. 28, 2018

(51) Int. Cl.
*A61J 15/00* (2006.01)
*A45F 3/04* (2006.01)
*A45F 3/00* (2006.01)

(52) U.S. Cl.
CPC ..... *A61J 15/0026* (2013.01); *A45F 3/04* (2013.01); *A45F 2003/003* (2013.01); *A61J 15/0015* (2013.01); *A61J 15/0073* (2013.01)

(58) Field of Classification Search
CPC ..... A61J 15/0026; A61J 15/0015; A61J 15/0073; A45F 3/04; A45F 2003/003
USPC ..... 224/576
See application file for complete search history.

(56) References Cited

U.S. PATENT DOCUMENTS 4,087,864 A * 5/1978 LaBove ..... A41D 13/1245 2/102
4,530,349 A 7/1985 Metzger
4,574,798 A * 3/1986 Heitzman ..... A61M 25/02 128/205.22
4,578,062 A * 3/1986 Schneider ..... A41D 13/1245 128/DIG. 26
4,666,432 A * 5/1987 McNeish ..... A61M 25/02 128/DIG. 26
4,688,270 A * 8/1987 Denicola ..... A41D 13/1272 128/874
4,998,654 A 3/1991 Bruzek et al.
5,048,122 A * 9/1991 Prieur ..... A41D 13/1272 2/111
5,048,512 A * 9/1991 Turner ..... A61J 15/0015 128/876
5,075,900 A 12/1991 Chittenden
(Continued)

FOREIGN PATENT DOCUMENTS

EP 0075753 A1 * 4/1983 ..... A61M 25/02
EP 0075753 B1 1/1985

OTHER PUBLICATIONS http://www.initforbennett.com/search?q=backpack.
(Continued)

*Primary Examiner* — Nathan J Newhouse
*Assistant Examiner* — Lester L Vanterpool
(74) *Attorney, Agent, or Firm* — Sarah J. Rhoades

(57) ABSTRACT

An improved system and device combining a vest and backpack for carrying an eternal feeding tube, pump, and nutritional supplements, particularly for children who are mobile but too small for a standard backpack. This vestpack includes straps and chest panels which cooperate for customizable fit to accommodate varying body sizes and treatment demands. The pack fits snuggly and securely holds the stored items against the child's upper torso but vertically spaced from the stoma port, thereby reducing interference and risk of ER visits to have ports reinserted. The straps and chest panels disengage from one another to permit quick and complete removal under any conditions. Transport components of the device include a hanger, milk pouch, tube restraint, and a pump pocket. Caregivers retain access to all functionality of the feeding system even while they are onboard, allowing convenient, everyday use and milk refills even while the backpack is worn.

14 Claims, 17 Drawing Sheets

(56) References Cited

U.S. PATENT DOCUMENTS 5,336,195 A 8/1994 Daneshvar
5,369,804 A 12/1994 Metcalf
5,403,285 A * 4/1995 Roberts ..... A61M 25/02 604/179
5,676,294 A * 10/1997 Eklund ..... A61M 5/1415 224/625
5,755,698 A * 5/1998 Kagan ..... A61M 25/02 604/179
5,806,096 A * 9/1998 Pennington ..... A41B 13/08 2/102
5,909,802 A * 6/1999 Puco ..... A45F 3/04 2/102
6,004,136 A * 12/1999 Ehrenpreis ..... A63H 33/3094 434/262
6,032,289 A * 3/2000 Villapiano ..... A41D 13/1245 2/102
6,206,854 B1 * 3/2001 Weaver ..... A41D 13/1245 128/DIG. 26
6,296,164 B1 * 10/2001 Russo ..... A61F 5/449 224/581
6,336,222 B1 * 1/2002 Ware ..... A41D 3/00 2/102
6,681,404 B1 * 1/2004 Adlard ..... A41D 13/1245 2/94
6,973,673 B2 * 12/2005 Beuk ..... A41D 13/1281 2/114
7,282,044 B2 * 10/2007 Hudson ..... A45F 3/04 604/174
7,810,172 B2 10/2010 Williams
8,763,562 B2 * 7/2014 Fladl ..... A41D 13/1245 119/850
8,807,412 B2 * 8/2014 Thomas ..... A61B 50/31 224/660
9,526,870 B2 * 12/2016 Simons ..... A61M 25/02
D829,895 S * 10/2018 Tetlow ..... A61B 50/31 D24/128
D855,993 S * 8/2019 Harris ..... D3/316
10,426,563 B2 * 10/2019 Dumesnil ..... A45F 3/12
2002/0016560 A1 * 2/2002 Hansen ..... A61H 9/0078 601/48
2002/0069444 A1 * 6/2002 Graham ..... F41H 1/02 2/2.5
2005/0224534 A1 * 10/2005 Hudson ..... A61J 15/00 224/158
2006/0253953 A1 11/2006 Williams
2009/0054844 A1 * 2/2009 Alyea ..... A41D 13/1245 604/179
2009/0272773 A1 11/2009 Andrade
2010/0181220 A1 * 7/2010 Dasara ..... A61B 50/31 206/438
2010/0282807 A1 * 11/2010 Sisk ..... A45F 3/02 224/602
2010/0325772 A1 12/2010 Fladl et al.
2013/0055483 A1 * 3/2013 Moreno ..... A41B 13/00 2/49.1
2013/0313284 A1 11/2013 Wang
2015/0237933 A1 * 8/2015 Abshire ..... A41D 13/1245 2/114
2015/0265352 A1 * 9/2015 Johnson ..... A61J 9/06 604/516
2017/0049166 A1 2/2017 Shorter

OTHER PUBLICATIONS https://clinicaltrials.gov/ct2/show/NCT02700282.
Camel, Breck, New Little Backpack, published Feb. 22, 2011, http://www.initforbennett.com/search?q=backpack.
Groupe Hospitalier Du Havre, Backpack Carrying in Children with Cystic Fibrosis, published Mar. 7, 2016, https://clinicaltrials.gov/ct2/show/NCT02700282.

* cited by examiner

ENTERAL FEEDING VESTPACK FOR CHILDREN

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

This invention relates to carrying apparatuses for medical feeding tube systems, and more particularly to such a carrying apparatus with a combination vest and backpack for improved carrying of enteral feeding tubes, pumps and feeding bags by children from the crawling stage of infancy through early childhood.

2. Description of the Related Art

Enteral feeding refers to the delivery of a nutritionally complete food, containing protein, carbohydrate, fat, water, minerals and vitamins, directly into the stomach, duodenum or jejunum. Enteral feedings may include medications. In this description the feedings may be collectively referenced as G feedings or enteral feedings and the nutrition or medications described may be referenced as only "milk." Enteral feedings are typically accompanied by a reservoir such as a bag with a tube exiting the bag, a pump to move the contents of the reservoir through the tube, and the tube terminating at a port on a patient wherefrom the feeding is completed according to the surgical design. The 500 mL reservoir bag such as that sold by Moog, Inc. contains milk that may be fed continually at a prescribed rate per hour (such as 80 mL per hour) or through a single or series of bolus feeds at a prescribed amount measured by volume (such as a single bolus feed of a 300 mL dosage of milk). The tubing alone will hold approximately 10-15 mL of the milk. Parents with a child requiring gastrointestinal enteral feeding tubes ("G tubes") are faced with many challenges when raising their child. An early challenge is encountered when a parent wishes to take an infant home but must learn to employ special care for the tube incision site and learn to prime a pump and prevent air from entering the feeding tube. One mother demonstrates one aspect of this process in an explanatory video at the following YouTube link: https://www.yotubecom/watch?v=_R3qikjobj4, the subject matter of which is hereby incorporated by reference in its entirety into this disclosure.

Another challenge begins when an infant becomes mobile and needs to move, develop motor skills, and experience the environment around him in order to maximize his early development and meet his needs for interaction and play as he grows. Backpack devices have been created seeking to allow G tube patients an "ambulatory mode" meaning they are able to move while having their enteral feeding. The backpacks currently available for infants are the same as those used by adults, which are much too large and unwieldy for an infant. An example of such a backpack is as shown online at: http.://www.youtube.com/watch?v=Ndtl9Pb9viY&feature=youtu.be. The devices such as the one illustrated at the above link do not enable the free and dynamic nature of an infant's movements while safeguarding the incision site and securing the medical device. Failures to present dislodging result in urgent visits to the ER to have the incision repaired and reinsert the medical device. Furthermore, the use of the currently available backpack is impractical as it requires additional steps of threading through eyelet openings and also requires unzipping in order to view and access the completely enclosed feeding components which at times need immediate attention and care. The complexity of supervising an infant with enteral feeding tube are further complicated by these added steps. While some prior devices have sought to solve the unique ambulatory needs of small children, they have repeatedly failed to address the shortcomings noted herein.

BRIEF SUMMARY OF THE INVENTION

The present invention is a combination vest and backpack which may be worn by a child beginning with the crawling stage of infancy and essentially "growing" with the child by virtue of its adjustability to accommodate a nearly infinite range of child sizes and shapes while maintaining a safe and practical fit. This improved enteral feeding carrying device stores and transports a tube, milk bag and pump with its pouch, pocket, and tube retaining elastic. The new and original strapping system and adjustable chest panel provide for a snug, infant-sized fit and meet unique movement needs of a child not addressed in the prior art.

A mesh bag pouch is designed to hold a milk bag but can hold any similar feeding or medication bag. The bag pouch has a cover flap with a bag nozzle refill access hole permitting access to refill the bag via the nozzle which protrudes through the refill access hole of the bag pouch. The bag pouch is constructed of a compressing material with an opening gathered at the top and surrounded with elastic to further support and secure the bag. The cover flap incorporates a fastener to interface and cooperate with a fastening mechanism located on the bag pouch and the two operate to secure the cover flap over the pouch. A pump pocket having a pump receiving sleeve is enclosed by a pocket flap. The pump pocket incorporates a fastener to cooperate with a fastener on the pocket flap. The pocket secures the pump and provides voids tailored to the pump controls, including a power cord access, a control panel cutout, a control panel flap to cover the cutout, and a tube access window which receives the tube when the pump is inserted into the pocket. The fasteners of the preferred embodiment pair hook and loop cooperating patches. Slack from the feeding tube is loosely contained by a tube restraint constructed of elastic with sufficient tension to gather and hold wound slack of the tube but loose enough to permit continued flow of fluid though the tube and avoid kinking. The tube restraint is located on the back of the device, safely out of the reach of the child. A looped strap atop the device provides a hanger important for suspending the device from a bed post, changing station, or IV stand and permits continuous and bolus feedings, such as at nap time or nighttime. By adding a simple clamp from a hardware store to a crib, high chair or car seat, a caregiver has the option of using the hanger to suspend the device from any surface while a child is sleeping or sitting.

Three components of the original strapping system of the present invention are underarm straps, shoulder straps, and a chest panel system each providing unique modes of adjustment. The three modes of adjustment of the strapping system give the device a unique and vital fit and functionality not otherwise available, particularly for small children and even more particularly for children who undergo frequent weight changes related to surgeries and medical treatments. The strapping system includes a right shoulder strap and a left shoulder strap which extend on either side of the device from the support backing near the bag pouch opening. Next, in the strapping configuration aspects of the preferred embodiment, a right underarm strap and a left underarm strap extend from either side of the device's support backing near the pump pocket and curve under the arm pit to hug the girth of the child's torso. A right shoulder (RS) fastener on the right shoulder strap interfaces and removably attaches to a right underarm (RU) fastener on the right underarm strap. A left shoulder (LS) fastener on the left shoulder strap interfaces and removably attaches to a left underarm (LU) fastener on the left underarm strap. In the strapping arrangement of the preferred embodiment, the fasteners are cooperating rectangles of hook and loop fasteners sized to provide an adjustment range relative to the rise of the pack on the child, thereby providing a better fit for children in a wide range of sizes. The chest panel system includes one or more panels with fasteners that cooperate with any other chest fasteners and the underarm straps. The primary chest panel has an exterior-facing chest panel fastener which cooperates with interior-facing fasteners on either underarm strap. In the preferred embodiment, the entire chest panel is almost completely comprised of hook fasteners which attach to the loop fasteners on the interior sides of the underarm panels. When the chest panel system includes an extender, the extender has its own interior-facing fastener to couple it together with the primary chest panel. On the opposite face of the extender, an exterior-facing extender fastener also cooperates with fasteners located on the interior of the underarm straps. In the preferred embodiment, the extender has a thin strip of loops on its interior face to removably fasten with the exterior hooks on the primary chest panel and like the primary chest panel, the extender is also nearly entirely comprised of hooks fasteners on its exterior face to permit maximum adjustability (both vertically and horizontally) when it is joined with the underarm straps. As an exception to this, either a single chest panel, underarm strap, or an extender includes a pull tab free of either hook or loop fasteners to provide a holding point for a caregiver to grasp the panel and begin separating the hook and loop fasteners as they remove the device from a child. The pull tab provides an important function of quick release as may be needed in some circumstances. The pull tab also facilitates removal of the vestpack without altering its size settings.

For an infant fitted with a G tube to move around he must carry his milk bag, pump, and G tube with him Many infants require milk feeding for extended periods of time in order to receive their required nutrition. Thus, the present invention permits an infant to become completely mobile while being fed and also includes features addressing the child's sleeping hours. With this device, an infant carries tubing, his feeding reservoir (typically a milk bag), and the pump that moves the food from the reservoir, through the feeding tube and into the incision site. Then, when the infant sleeps, a parent may transfer the vestpack to a hanging location for the feedings to continue throughout the night. An aperture in the pump receiving section allows for the power cord to be plugged into a power source for battery recharging while the child sleeps.

More specifically, and in a presently preferred embodiment, by way of example and not necessarily by way of limitation, the present invention meets a plethora of objectives. Mobility and physical development of a child with a feeding tube or similar medical device are improved when a child in the infant stage begins the skill of crawling on hands and knees and pushing up to a standing position, then the skill of walking in the toddler stage, and finally achieving the wide range of activity of a young child. Children commonly require feeding tubes prior to and throughout their development stages. For example, a child requiring a gastric tube be placed in his abdomen at six months of age may begin crawling at age nine months. The present invention snugly holds and supports the weight of the child's pump, milk bag, and tubing without shifting or interfering with his balance or movements. Existing backpacks may actually be larger than the child himself, shift during movement, and do not balance and support the weight of the pump and milk bag, thus impeding the fullness and freedom of movement critical to the development of the child's motor skills. A child using the present invention is no longer confined to the use of the prior art and is freed from the undesirable options of either confinement or risk of dislodging the stoma port. The child is no longer confined to his crib or playpen and will not be hindered from developing the basic skills and physical strength and endurance associated with the first milestones of infant development (crawling, standing, walking, climbing, etc.). The present invention reduces incidents of dislodging of the feeding tube from the child's stomach, saving the pain and expense of stressful trips to the emergency room where the tube must be reinserted. The present invention is not only smaller to accommodate the child's small body and agility needs, but it also can be secured with the fastening straps so that it will not shift as he moves. The present invention also appropriately centers and supports the weight of the pump and milk bag to facilitate the child's balance and movement. Importantly, the present invention aspects and features ensure that the device will not interfere with the location of stoma port and provide readily visible and accessible access to the feeding components for quick assessment, maintenance, and servicing.

By providing a safe, comfortable, and accessible design, the freedom of mobility is restored to the child and peace of mind to the parent as the child then grows and achieves the basic milestones of development in their natural timeline. The present invention provides a better design for a wearable medical backpack/vestpack for a young child. The vestpack, being no larger than absolutely necessary, is ultra light-weight, and is designed with a chest and shoulder strap closure which, when fitted to the individual child for size and shape, (1) prevents the pack and its contents from shifting due to physical activity or positioning, (2) allows free and full breath support of the lungs while remaining supported, (3) centers the weight of the pump and milk bag to facilitate the child's balance and movements, (4) avoids interference with installed medical devices or lines (g-tube, jg-tube, ng-tube, intravenous lines, etc.), and (5) provides easy access and quick visible access to and assessment of carried devices and tube lines for the caregiver. Such freedom in mobility for a child greatly improves quality of life for the child and also for parents. When travelling by air, the vestpack is most appreciated at checkpoints for its ease of visibility and access for inspection. The materials used were chosen for durability, easy on-the-go maintenance and spot-cleaning, and to prevent slippage or stretching of size settings so that the vestpack fits snugly and securely on the child's body.

The foregoing has outlined, in general, the physical aspects of the invention and is to serve as an aid to better understanding the more complete detailed description which is to follow. In reference to such, there is to be a clear understanding that the present invention is not limited to the method or detail of construction, fabrication, material, or application of use described and illustrated herein unless otherwise stated. Some variation of fabrication, use, or application should be considered apparent as an alternative embodiment of the present invention.

BRIEF DESCRIPTION OF THE DRAWINGS

The following drawings further describe by illustration, the advantages and objects of the present invention. Each drawing is referenced by corresponding figure reference characters within the "DETAILED DESCRIPTION OF THE INVENTION" section to follow. The drawings should be reviewed collectively to appreciate all of the aspects, features, and component reference numbers of the invention.

DETAILED DESCRIPTION OF THE INVENTION

Figure 1:
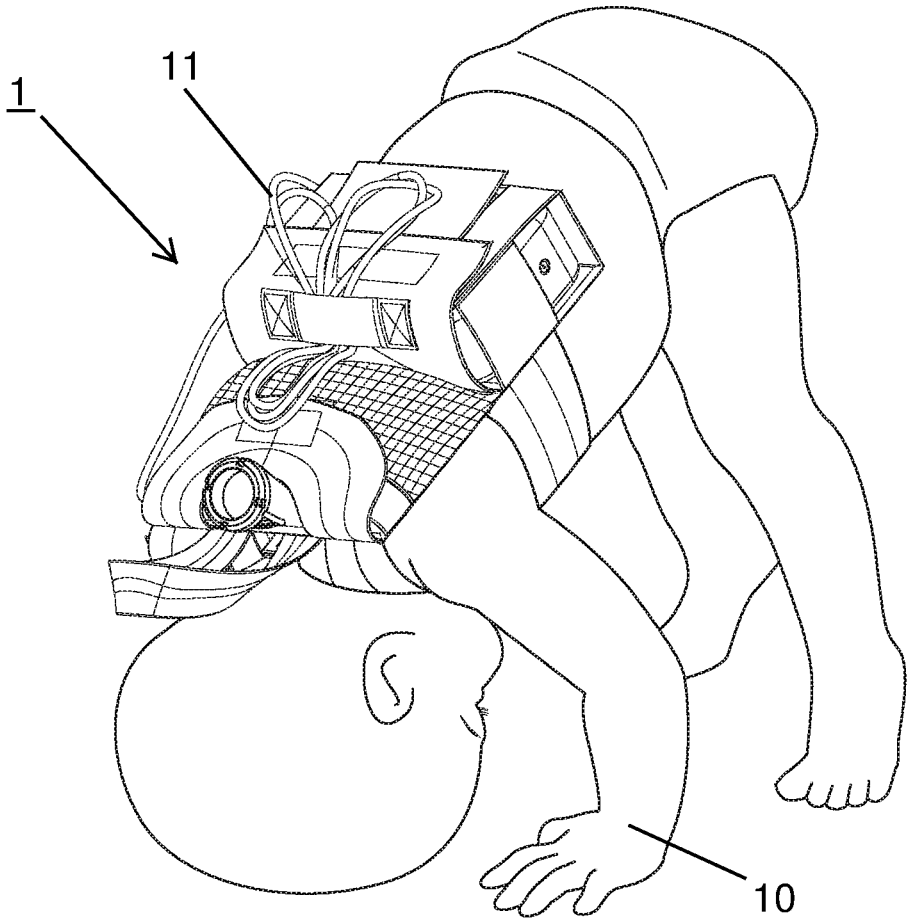
FIG. 1 is a rear perspective view of the device worn by an infant during rambunctious play and having a pump, feeding bag and tube inserted and in use.

In FIG. 1, an infant 10 requiring a feeding tube 11 is illustrated during lively play, mimicking a head stand, and wearing the device 1. While the child 10 is nearly inverted, the present invention is securely held in place by the novel features described herein, preventing shifting of the pump and milk bag that could interfere with the child's balance and movement, or disengage the feeding tube. The underarm straps and shoulder straps (labeled in later views) conform to the shape of the child's torso while providing flexibility and adjustment features which allow a snug and hold-fast fit in spite of the contortion of the child's body during movement and play. The unique shape of the straps fits a baby shape and prevents any buckling of the materials. The feeding tube 11 is held safely out of the way of the child's arms and legs. As described herein, the arm straps cooperate with the chest panel to adjustably fit the infant's torso.

Figure 2:
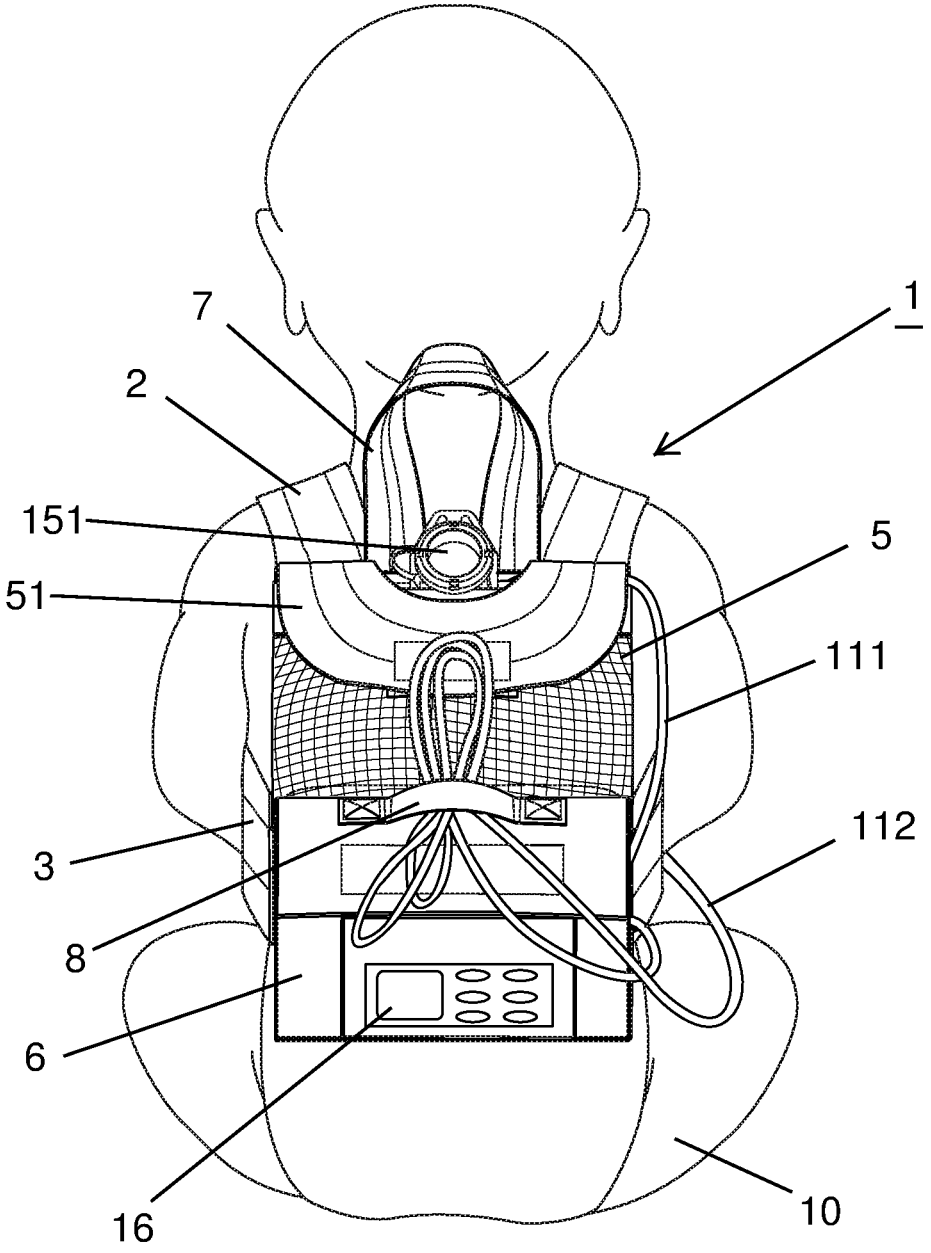
FIG. 2 is a back view of the device worn by a seated infant and having a pump, feeding bag and tube inserted.

With reference to FIG. 2, the backpack device 1 is shown from a rear view while being worn by a seated infant 10. Shoulder straps 2 extend over each shoulder on either side of the child's head. Underarm straps 3 curve under each arm and extend around the child's sides. The device 1 comprises a milk pouch 5 to receive a milk bag 15 (see FIGS. 18-19) and a pump pocket 6 to receive a feeding pump 16 and an elastic, tube retainer 8 assists with feeding tube 11 management as highlighted in FIG. 1. The milk pouch 5 and pump pocket 6 incorporate additional features and aspects described in more detail in later figures. The device 1 accommodates the existing medical accoutrements of tubing 11, a milk bag 15, a pump 16 all of which must be carried by a mobile child requiring enteral, or G tube feedings. Feeding occurs on an ongoing basis as milk is carried via the first section of the tube 111 from the milk bag 15, through the portable pump 16 and then through the second section of the tube 112 around to the child's stoma port 14 (see FIGS. 3, 16, and 20). A hanger 7 is provided to permit the device 1 to be hung (demonstrated in FIG. 20) or carried by a caregiver when not being worn, such as during sleep, diaper changes, and bathing. When the device is worn by the child, a parent may choose to fold the hanger down so that it loops around the milk bag nozzle 151 near the pouch flap 51.

Figure 3:
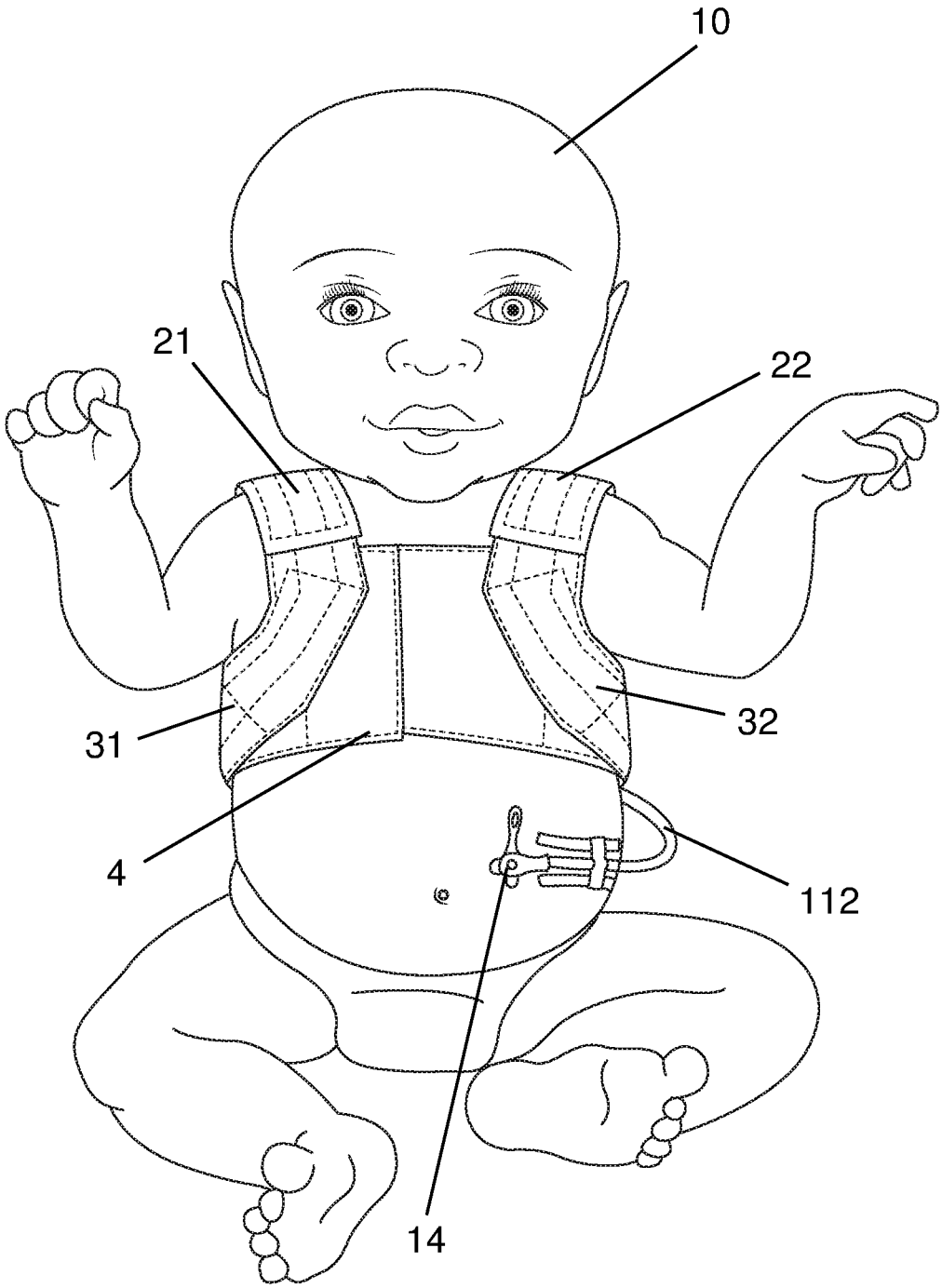
FIG. 3 is a front view of the device worn by an infant and showing the position of the chest panels and straps relative to an incision site and a stoma port necessary for G tube feedings.

Turning to FIG. 3, an illustration from the front of the child 10 shows the respective positions of the right shoulder strap 21, the left shoulder strap 22, the right underarm strap 31, the left underarm strap 32, and adjustable chest panel 4. Clearance from the stoma port 14 is important in order to avoid irritation or worse, dislodging of the G tube which necessitates immediate treatment in an emergency room or hospital. Also important is the location of the adjustable chest panels 4 above the diaphragm so that there is no interference or impediment to the free breathing and breath support needed for the lungs of a child, even at play. For other variations of the present invention, the size of one or more chest panels 4 and/or the size and shape of the shoulder straps 2 and underarm straps 3 could be arranged to accommodate other medical portals in the chest or stomach area of the child. The specific manner of affixing and removing the straps and chest panels of the present invention permits the use and accommodation of other devices on the child 10—such as if the child has a PIC line or IV line in an arm—and the device 1 can be put on and taken off without disturbing or disconnecting the line because the straps fully open and chest panels removed as illustrated in FIGS. 9-13. In the instance of FIG. 3, the device 1 is shown with a section of tubing 112 running around one side of the child 10 as compared with FIGS. 1-2 and 4 where the tubing is illustrated on the child's other side. The routing direction is a matter of personal preference or medical need and does not impact the utility of the present invention.

Figure 4:
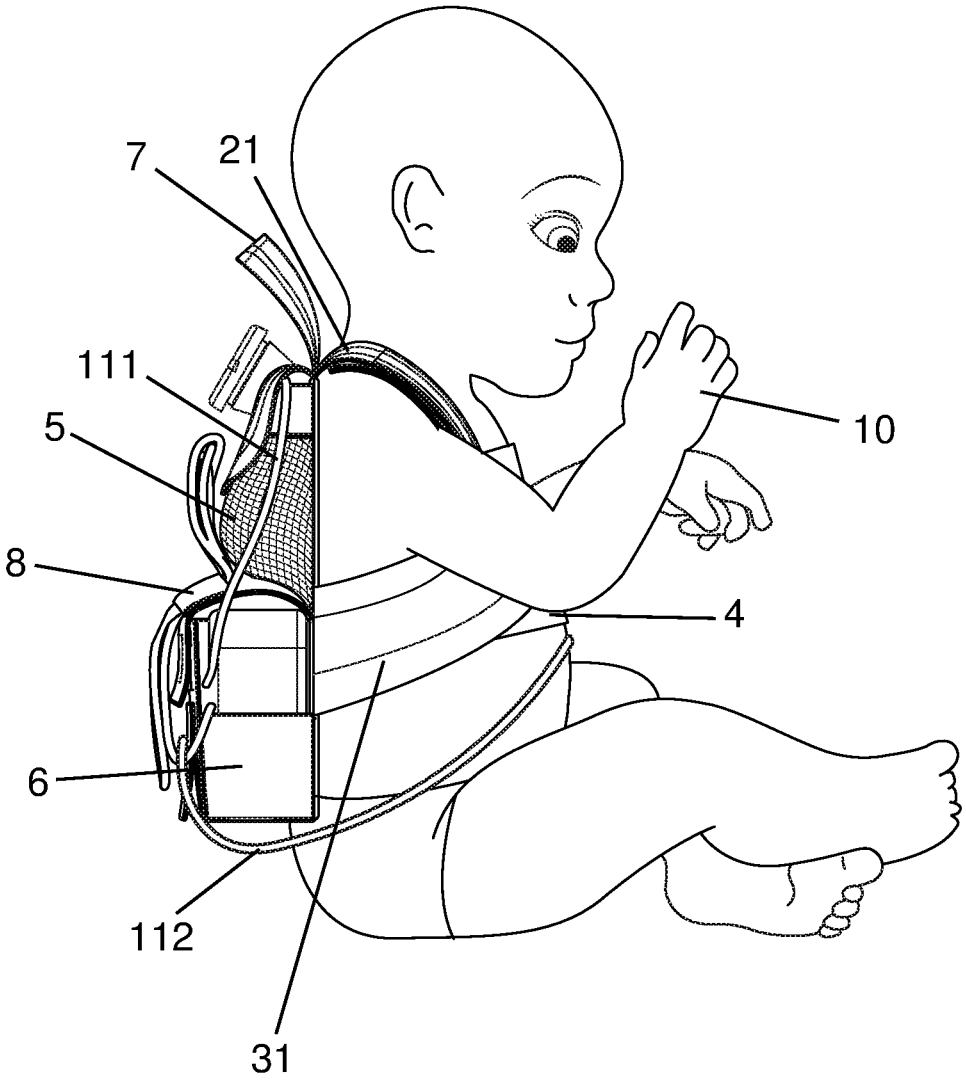
FIG. 4 is a right side view of an infant wearing the device having a pump, feeding bag, and tube inserted.

In FIG. 4 an infant 10 is illustrated from the side. The right shoulder strap 21 and right underarm strap 31 are engaged with the adjustable chest panels 4. The side view clearly depicts the relative positioning of the hanger 7, milk pouch 5, pump pocket 6 and tubing retainer 8 of the preferred embodiment of the present invention (see additional detail below). The first tube section 111 is illustrated leaving the top of the milk pouch 5 traveling to the pump 16 in the pump pocket 6 and the second tube section 112 travels toward the child's stomach to engage the stoma port 14 as shown in FIG. 3. The tube retainer 8 loosely but reliably secures the feeding tube 11 slack as shown in FIGS. 1-3, and 5.

Figure 5:
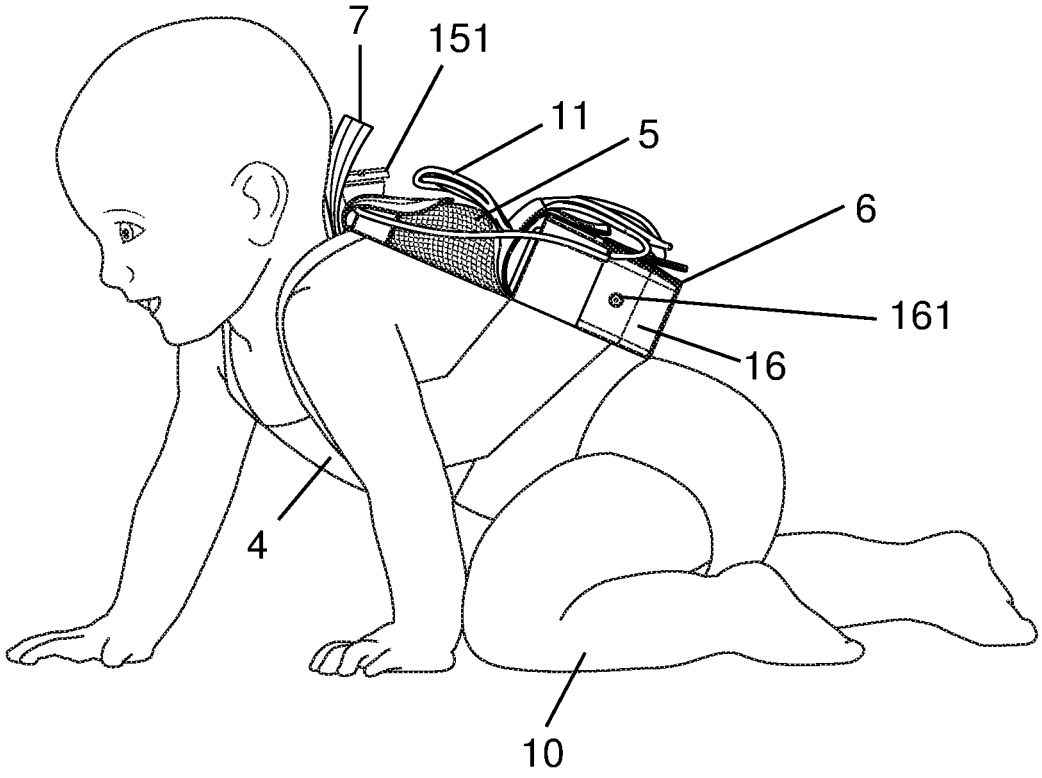
FIG. 5 is a left side view of the device worn by a crawling infant receiving mobile feeding by using the device having a pump, feeding bag and tube employed.

A child 10 is shown in a crawling position while wearing the device in FIG. 5. The side view clearly depicts the relative positioning of existing feeding items during use of the device 1. At the top, the hanger 7 is above the milk bag nozzle 151 protruding from the milk pouch 5. The pump 16 and example electrical port 161 are within the pump pocket 6. The figure further showing the tubing 11 running between the bag and pump as they are all held securely in place by the backpack and multiple pieces of the vest's shoulder straps and underarm straps engaging the adjustable chest panels 4 of the present invention. The engagement of the shoulder straps and underarm straps with the chest panels are described in more detail and called out with reference numbers below. Once closed over the milk bag nozzle 151, the milk pouch flap 51 is secured to the mesh body of the milk pouch 5 by a cooperating securing mechanism.

Figure 6:
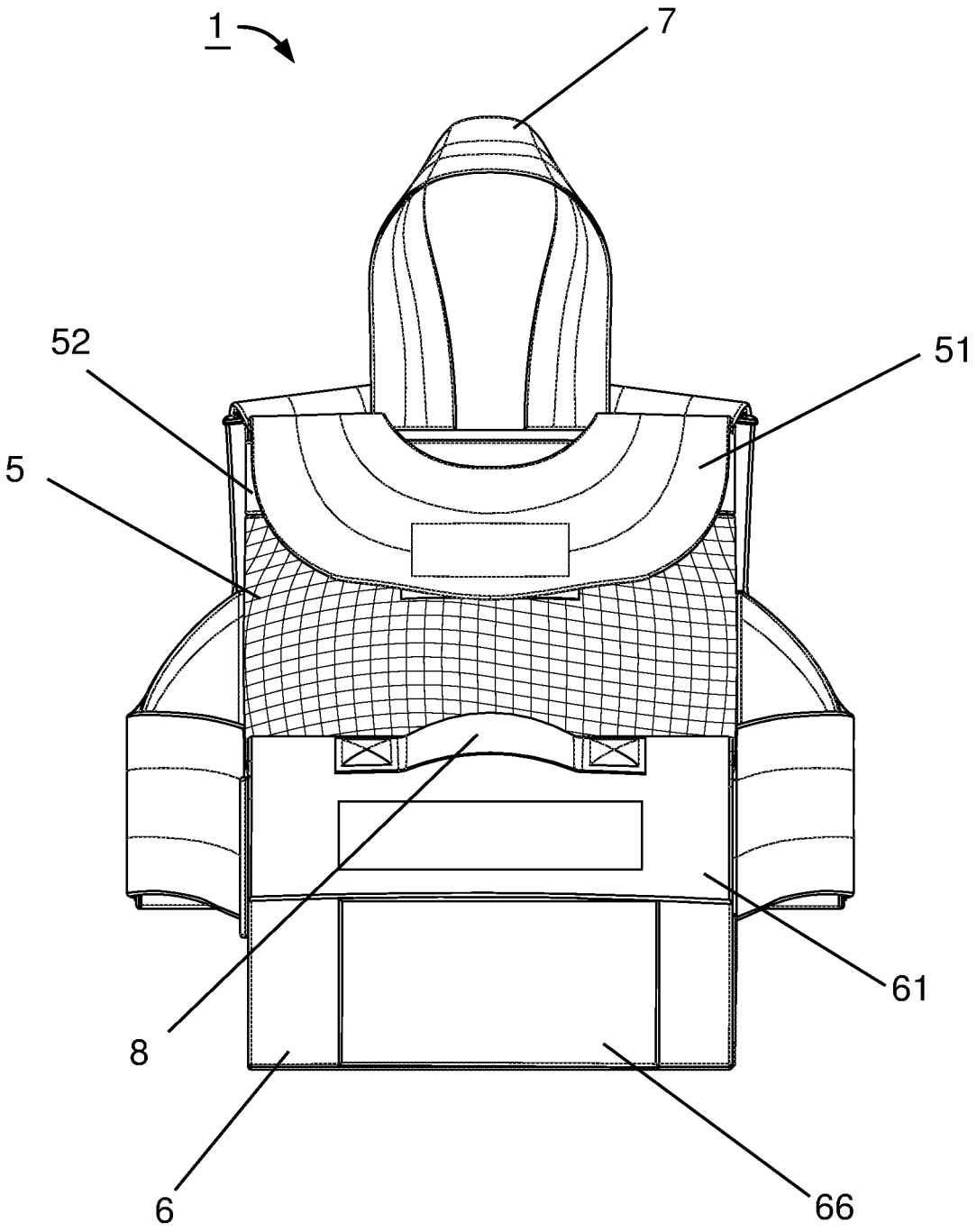
FIG. 6 is a back view of the present invention in a closed configuration.

The present invention will be commercially available as illustrated in FIGS. 6-9, typically without tubing, a pump, milk bags, formula or other accessories which are provided separately. The device 1 is shown in a closed configuration from the pocket-pouch backpack view in FIG. 6. The milk pouch 5 is disposed near the hanger 7 and top of the pocket-pouch backpack section of the present invention. The top of the milk pouch 5 is supported by an elastic closure 52, visible on either side of the milk pouch closure flap 51 in FIG. 6. The space between the pouch elastic 52 and the pouch flap 51 creates a natural path for the tube 11 to exit the pouch (see FIGS. 4, 18-19) after the milk bag 15 is inserted into the mesh pouch 5 without any need to thread or feed the tube through a channel or eyelet. The milk pouch 5 is closed by the milk pouch flap 51 and the compressible mesh of the milk pouch 5 and elastic 52 provide support to the malleable and collapsible plastic containers used for most milk bags 15. With continuing reference to FIG. 6, the pump pocket 6 is disposed below the milk pouch 5 in the preferred embodiment. A pocket flap 61 covers the pump 16 (see FIGS. 1-5) when it is inserted into the pump receiving sleeve 67 (see FIG. 17). In the illustrated embodiment, the elastic tube retainer 8 occurs between the milk pouch 5 and the pump pocket 6 and more particularly on the pump pocket flap 61. This is but one example of the tube retainer 8 aspects of the present invention. The position for the milk pouch, pump pocket, and tube retainer may be altered slightly to other locations and in other arrangements so long as it meets the objectives of the present invention.

Figure 8:
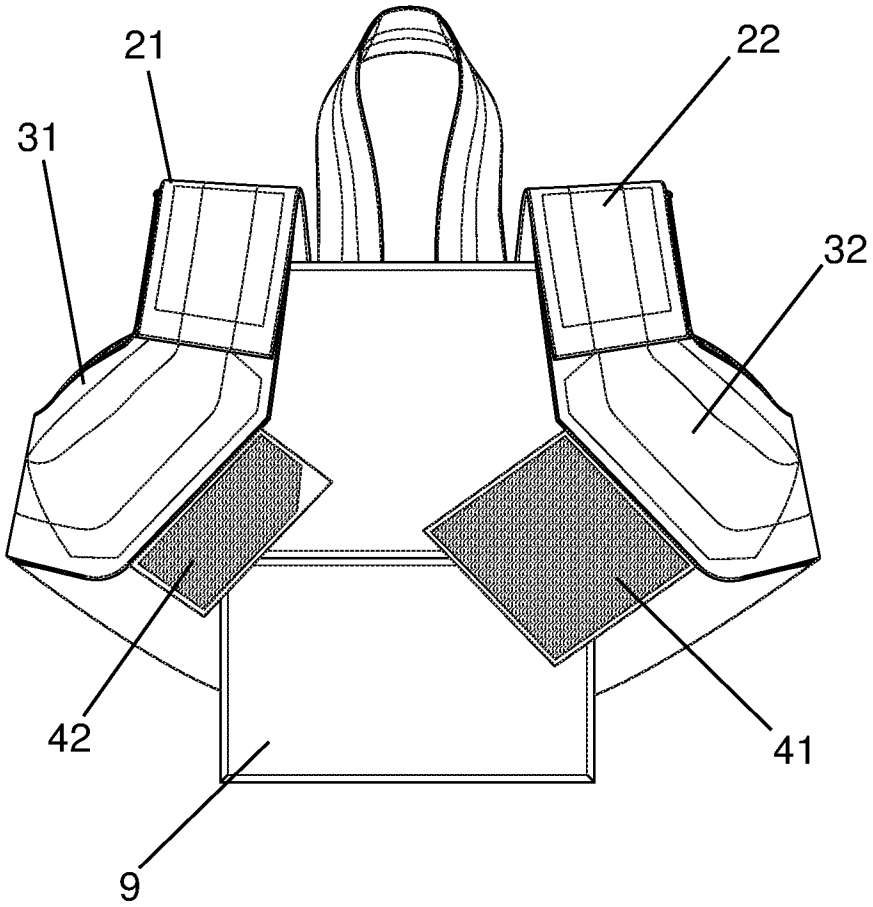
FIG. 8 is a front view of the device in a partially closed configuration showing one adjustable chest panel disengaged from another adjustable chest panel.
Figure 7:
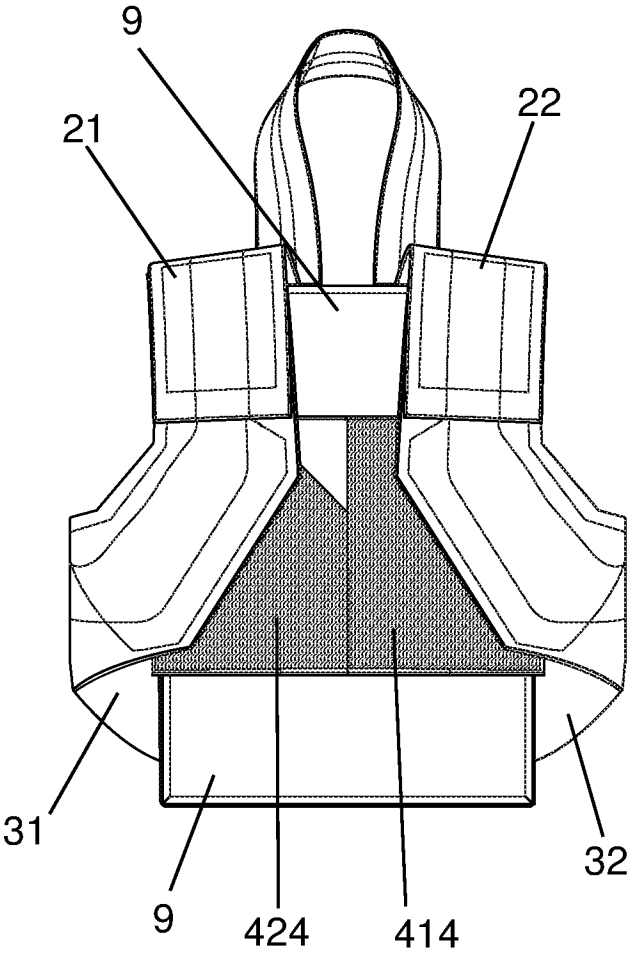
FIG. 7 is a front view of the device in a closed configuration with the adjustable chest panels installed and partially visible.

FIG. 7 also shows the device 1, particularly the vest aspects, in a closed configuration from the front, breast view. An example of the padded backing 9 of the pack portion is depicted in FIGS. 7 and 8. The padded backing 9 may be foam or heat reflective padding. The left underarm strap 32 and the right underarm strap 31 wrap around to cooperate with the left shoulder strap 22 and right shoulder strap 21 and support the pouch-pump aspects of the invention. In the preferred embodiment, the chest panels attach to the underarm strap section of the joined straps. The preferred mode of attachment calls for interior-facing loop fasteners on the underarm straps to cooperate with outward facing hook fasteners on the chest panels. In the preferred embodiment, a first set of chest panel fastening hooks 414 join with the left underarm strap 32 and also with a set of extender panel fastening loops 423 shown in FIG. 13. Meanwhile, the right underarm strap 31 joins by hook and loop fastening with the cooperating aspects of the second set of chest panel fastening hooks 424. The chest panels and their fastening means are described in more detail in FIGS. 12-15.

In FIG. 8, another front, breast view, the multi-piece vest is shown in a partially open position. As the device is beginning to be disengaged, the two adjustable chest panels are separated but still attached to the respective underarm straps. A first chest panel 41 is shown pulling away from a second chest panel 42. For some children, this may be the only disengagement necessary to remove the device from the child's shoulders by removing the left shoulder strap 22, still attached to the left underarm strap 32 over the child's left arm and also removing the right shoulder strap 21 still attached to the right underarm strap 31 from the child's right arm. However, for children with extraordinary needs, additional options are provided to completely remove the device from a child by the total disengagement shown in FIG. 9 where the shoulder straps are disengaged from the underarm straps and two adjustable chest panels have been completely detached from the underarm straps. All of the regularly detachable and adjustable components are pulled apart in FIG. 9 to demonstrate their versatility or removability. The removed, two chest panel adjustment panels are shown in more detail in FIGS. 12-13.

Figure 9:
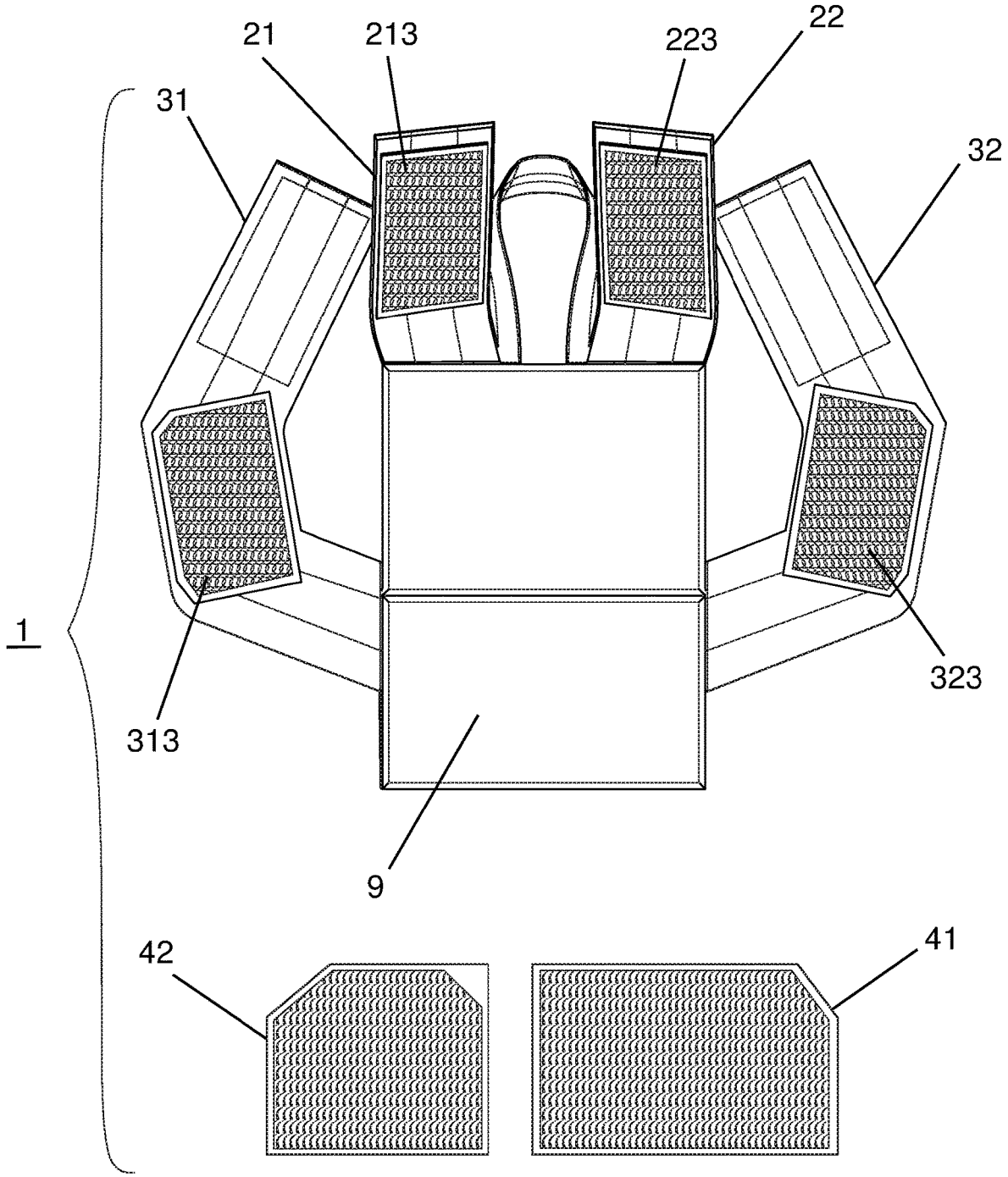
FIG. 9 is a front view of the present invention in an open configuration showing the adjustable chest panel completely disengaged from the other adjustable chest panel and the shoulder straps and underarm straps lying flat exposing fasteners and showing the size adjustment system of the present invention.
Figure 10:
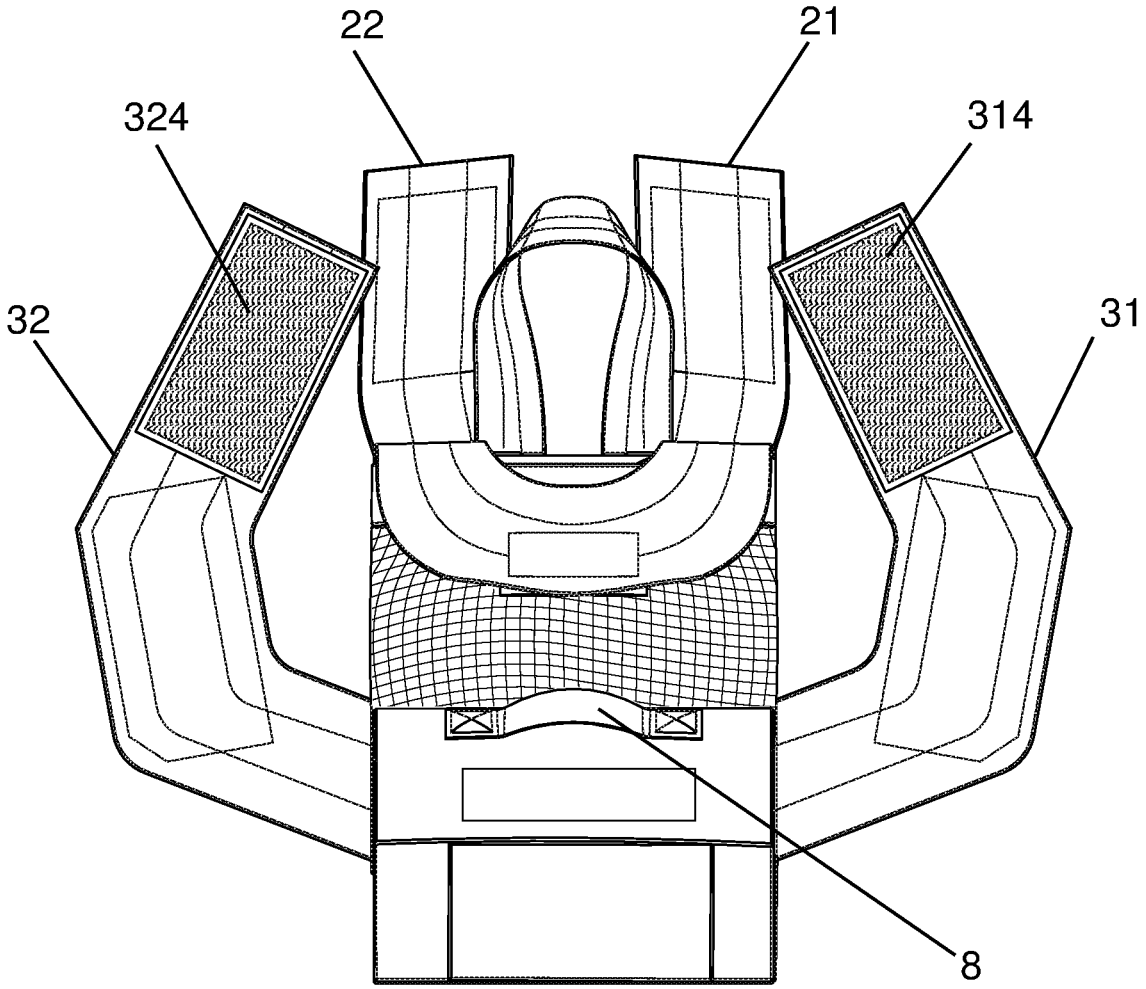
FIG. 10 is a back view of the device laid flat in an open configuration with the chest panel adjustments removed.
Figure 11:
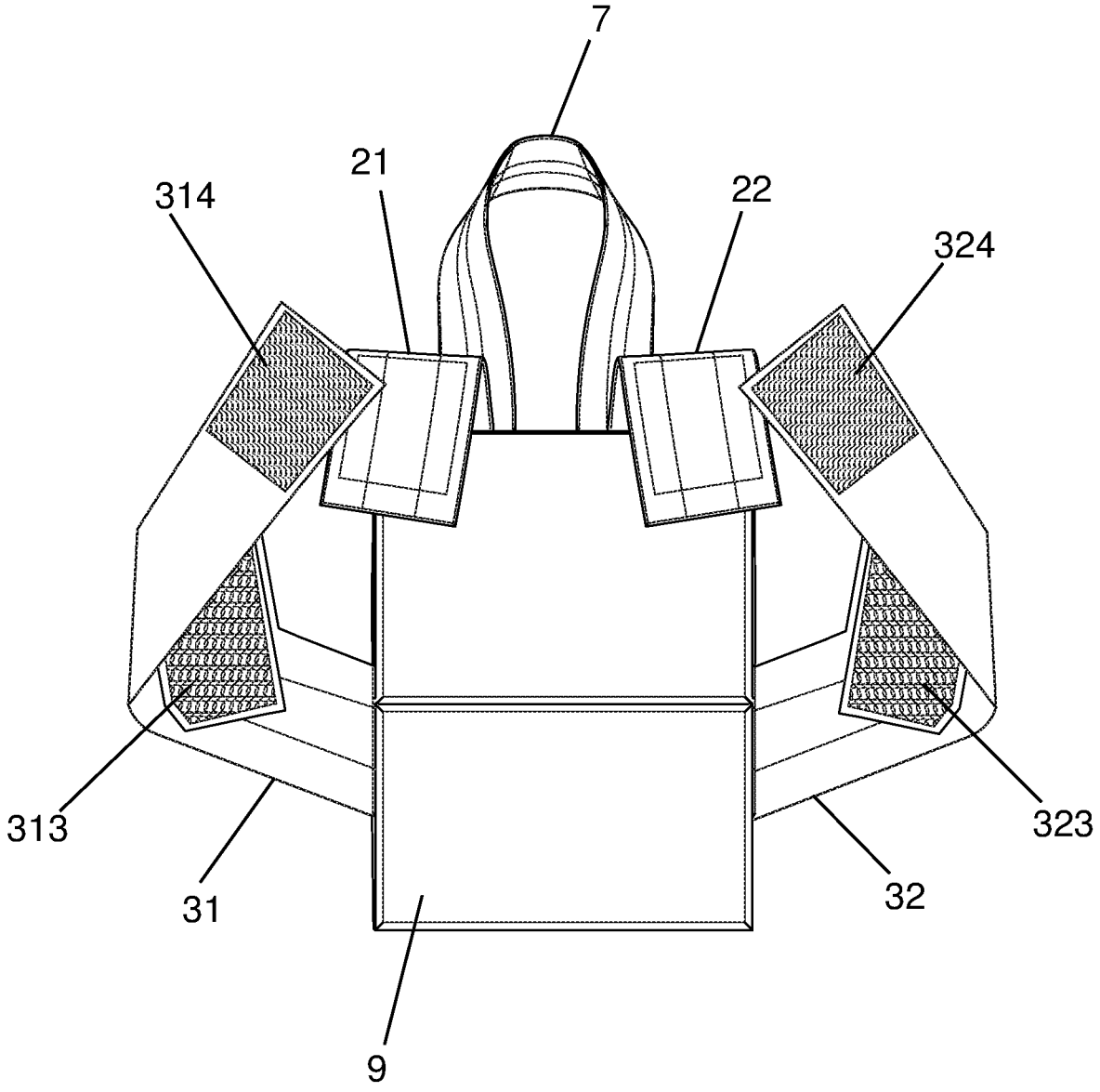
FIG. 11 is a front view of the preferred embodiment of the device showing the underarm fastening panels ready to reengage with the shoulder fastening panels once they are tucked under the respective shoulder strap.

With collective reference to FIGS. 9-11, the padded backing 9 is shown on the interior of the device 1 and is also appreciated from the double seam layers shown on the left shoulder strap 22 and right shoulder strap 21. As an important feature of the present invention, padding 9 is incorporated into the various aspects that touch the child and is particularly focused in the back-panel areas for protecting the child from the contents of the device as he or she lays back. Thinner padding is also needed around the strap areas, which may be inherent in the fabric chosen or may be inserted and quilted between layers of the vestpack's materials.

The right 21 and left 22 shoulder panels in FIG. 9 are lifted to expose the right and left shoulder strap loop fasteners 213, 223, respectively. The right 31 and left 32 underarm panels are extended to expose the right and left underarm loop fasteners 313, 323, respectively. Finally, the hook fasteners of the completely disengaged chest panel 41 and extender 42 are displayed.

FIGS. 10-11 demonstrate additional details of the invention visible with the chest panels 4 detached and the straps of the illustrated strapping arrangement laid open. FIG. 10 shows the other side of the shoulder fastening panels and the underarm straps 31, 32 with hook fasteners 314, 324, disengaged from the shoulder fastening panels. FIG. 10 is a pocket-pouch, rear view of the device shown in the upper portion of FIG. 9. The right shoulder strap 21 is detached from the right underarm strap 31 and laid flat. The left shoulder strap 22 is detached from the left underarm strap 32 and laid flat. In FIG. 10, the left underarm fasteners 324 of the preferred embodiment are exterior-facing hooks which engage with the left shoulder strap 22 and specifically the cooperating left shoulder strap (LS) fastener 223 shown in FIG. 9. In the preferred embodiment, complementary fastening means are employed, and loop fasteners face the child and are formed to mate with the hook fasteners facing away from the child. Shown in FIG. 10, the right underarm fasteners 314 of the preferred embodiment are exterior-facing hooks which engage with the right shoulder strap 21 and specifically the cooperating right shoulder (RS) fastener 213 shown in FIG. 9. Again, in this case, complementary, interior-facing loops are formed to mate with exterior-facing hooks. FIG. 11 depicts the movement of the straps as they are brought toward one another for engagement. The right shoulder strap 21 aligns and joins by a fastener or cooperating attaching means with the right underarm strap 31. Meanwhile, the left shoulder strap 22 of this strapping configuration aligns and joins by a fastener or cooperating attaching means with the left underarm strap 32. More particularly, the right shoulder strap 21 has been folded over so the right shoulder (RS) fastener 213 (not visible), now facing inward, is ready to interface with the right underarm (RU) faster 314. On the left side, the left shoulder strap 22 is folded over, the left shoulder (LS) fastener 223 is no longer visible because it is facing inward ready to interface with the left underarm (LU) fastener 324. FIGS. 9-11 show the hook and loop layout of the preferred embodiment, the right shoulder (RS) fasteners 213 and left shoulder (LS) fasteners 223 are rectangular sections of loop fastener and the right underarm (RU) faster 314 and left underarm (LU) fastener 324 are rectangular sections of hook fasteners. The length, shape and size of the panels of coordinating hook and loop fasteners permit variation and adjustment to a child's body dimensions. The shoulder and underarm straps can overlap more for a smaller fit and overlap less for a larger fit.

Figure 12:
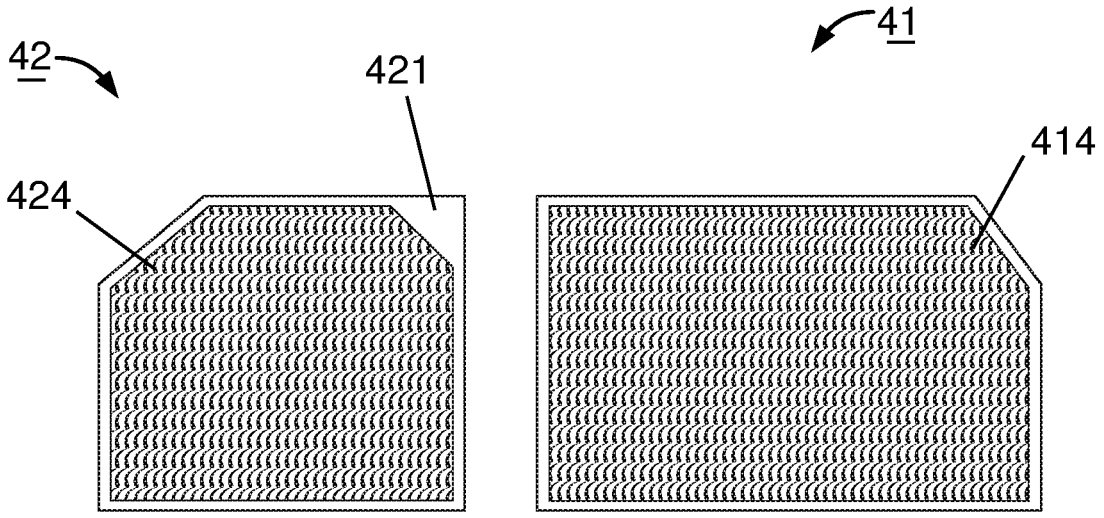
FIG. 12 is a front view of two adjustable chest panels, a primary and an extender, completely disengaged and shown in isolation with detail of the chest panel engaging hooks
Figure 13:
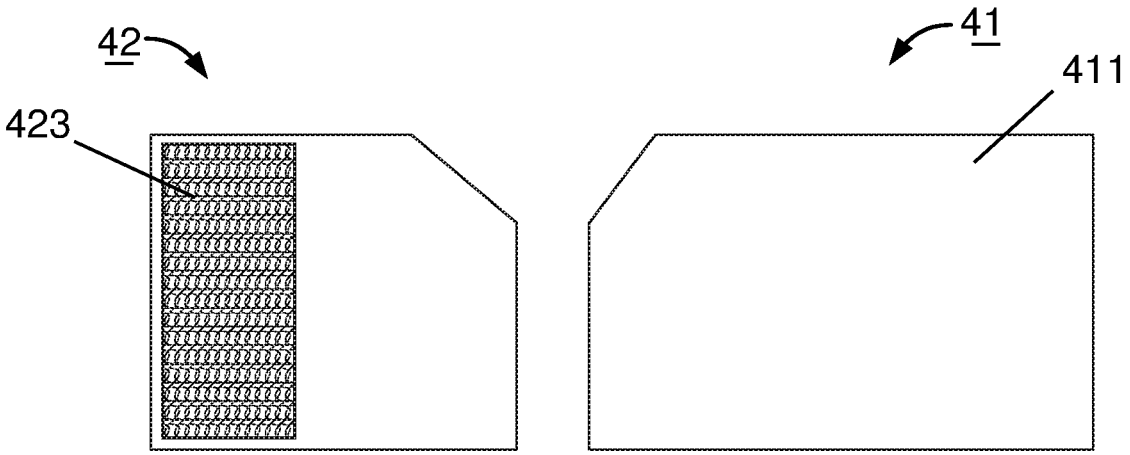
FIG. 13 is a back view of two adjustable chest panels, a primary and an extender, shown in isolation and demonstrating a loop and fastener free arrangement according to one embodiment of the present invention.

FIGS. 12-13 show in isolation, the adjustable chest panels specifically comprising the breast plate 41 and breast plate extender 42 which acts as an extension piece. Both of the panels are depicted as unattached within FIG. 9. FIG. 12 is a front view of both the breast plate 41 and breast plate extender 42. In the preferred embodiment, a first surface of the breast plate is ideally covered with hooks 414 in order to engage the loops of each of the underarm straps at many varied angles and positions (see FIGS. 14-15) allowing versatility and customized fit to the child and accommodating any medical or comfort needs. Other embodiments may allow for variations on the type, amount, or location of the chest panel-to-strap securing means. In the preferred embodiment, the breast plate extender 42 is provided to permit even further growth and sizing options. The breast plate extender 42 is also nearly covered with adjustable fastening means such as hooks 424. In the preferred embodiment, at least a small triangular section of the extender is free from hooks to serve as a pull tab 421 and assist with easy separation of the breast plate extender 42 from the breast plate 41 and quick release by a caregiver, sometimes vital in medical situations. The extender 42 is optional and its use may be implemented or cease depending on size variations of the child. If no extender is employed, the pull tab 421 may be located on an underarm strap or on the primary breast plate 41. Additionally, multiples of breast plates 41 or extenders 42 could be employed to provide additional variability or meet objectives of manufacturing. The breast plate 41 may directly cooperate with aspects of the strapping, for example, each of the left underarm strap 32 and the right underarm strap 31. In FIG. 13, the breast plate 41 and breast plate extender 42 have been flipped over to expose their rear faces. In the preferred embodiment, the breast plate rear face 411 is free of all fastening means. Then, the breast plate extender 42 has only a small strip 423 of loops (of a hook and loop fastening system) on its rear face to engage the breast plate front surface 414 when employed. The adjustable chest panels only have interior-facing loops or no loops because these components may be in contact with the skin of the child. No hooks should be used on those surfaces in order to minimize discomfort if the child is wearing the device without clothing under the vestpack.

Returning to FIG. 9, in no particular order of operation, the breast plate 41 is detached from the left underarm loop 323. The breast plate extender 42 is detached from the breast plate 41 and also the right underarm loops 313. The right underarm strap 31 and the left underarm strap 32, in particular the hooks 314 and the hooks 324 shown in FIGS. 10 and 11, are disengaged from the right shoulder strap 21 and left shoulder strap 22, respectively. The loops 213 and loops 223 cooperate with the hooks 314 and hooks 324, respectively, as also illustrated in FIGS. 9-11, in order to connect and engage the strapping configuration, but also to make it fully-releasable.

Figure 14:
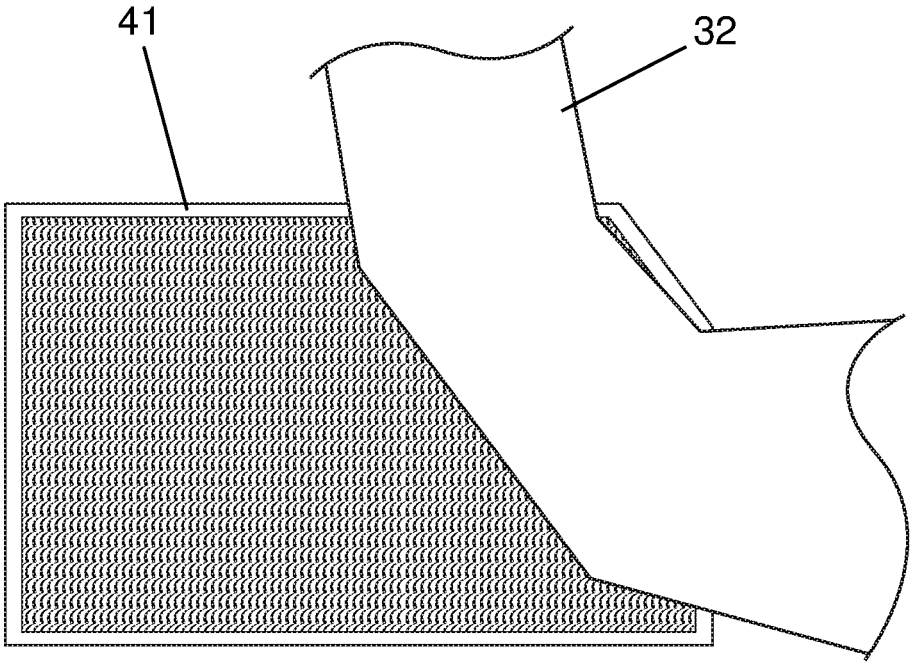
FIG. 14 is a front tear-away view of the first chest panel shown in isolation with the chest panel engaging hooks partially engaged with the underarm panel illustrating one method by which to adjust and customize size and angles for the invention.
Figure 15:
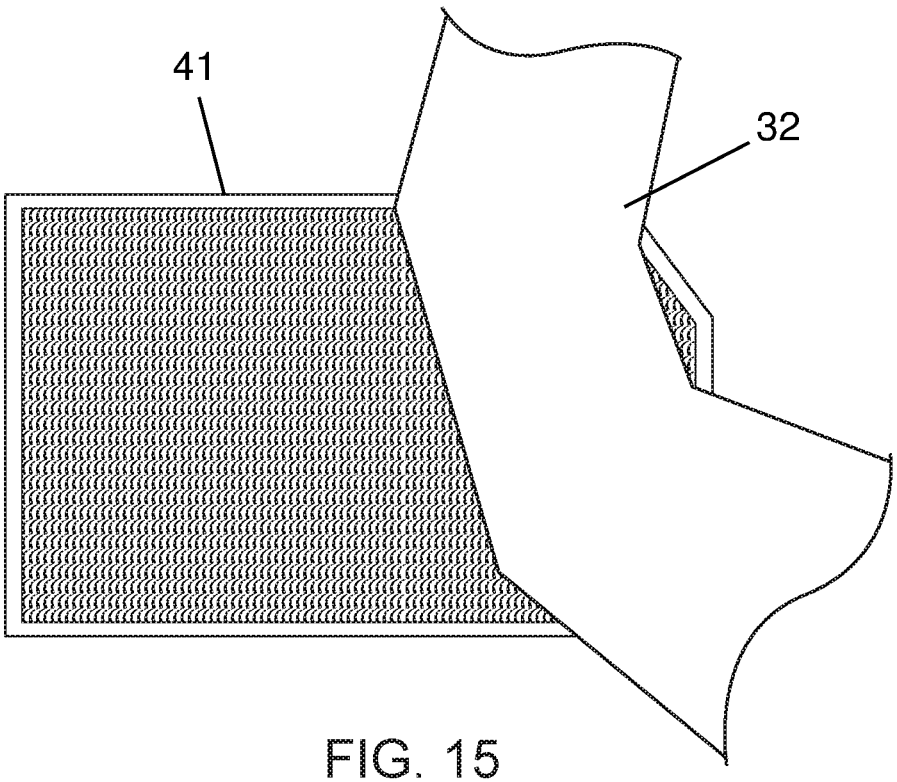
FIG. 15 is a front tear-away view of the first chest panel shown in isolation with the chest panel engaging hooks partially engaged with the underarm panel illustrating another method by which to adjust and customize size and angles for the invention.
Figure 16:
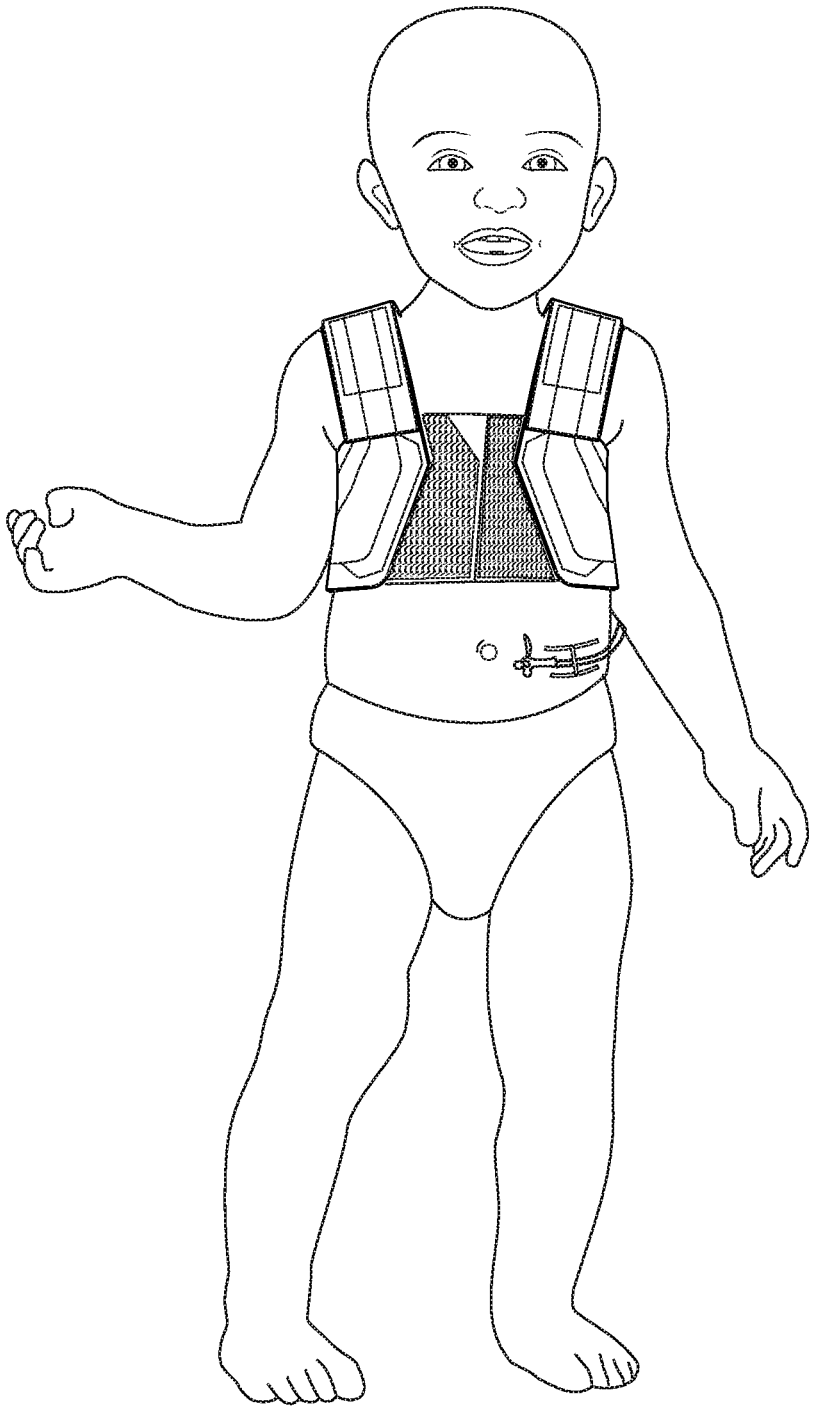
FIG. 16 is a front view of the present invention worn by a toddler.

FIG. 14-15 illustrate two examples of the left underarm strap 32 and its interior-facing fasteners 323 (see FIG. 9) of the strapping configuration engaged with the adjustable breast plate 41 while the device is in use. The mirror image would be true for the engagement of the right underarm strap 31 and its interior-facing fasteners 313 with either the other side of the breast plate 41 or a breast plate extender 42, if employed. Each of the adjustable chest panels are illustrated as irregular pentagons in the preferred embodiment; however, alternative shapes may be used when the number of panels employed are altered. Importantly, the shape includes soft corners, and thus sections with no hooks, in the area of the panels which would be near a child's underarm. FIG. 16 illustrates the strapping and fastening components once again engaged and worn by a toddler. The first adjustable chest panel of the breast plate 41 and second adjustable chest panel of the breast plate extender 42 are utilized to attach the device 1 to the child 10 at a distance from the stoma port 14. While left and right references are used in the drawings, the chest panels may be used solo or in various combinations which are not restricted by "left" or "right."

Figure 17:
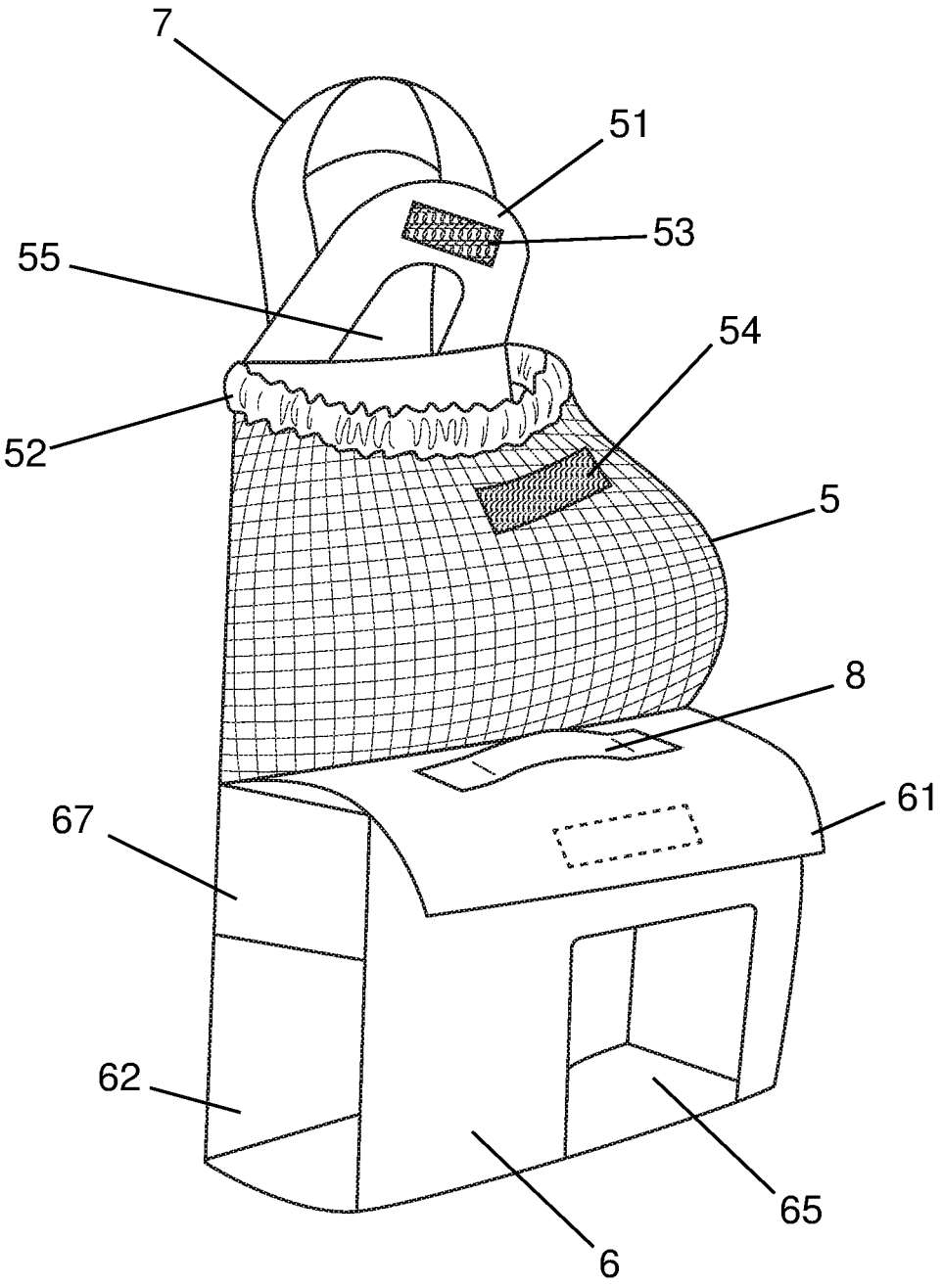
FIG. 17 is a rear perspective view of an alternative embodiment of the device with the strap components removed to show detail of the hanger, open milk pouch cover, closed pump pocket, and tubing retaining strap aspects of the present invention.
Figure 18:
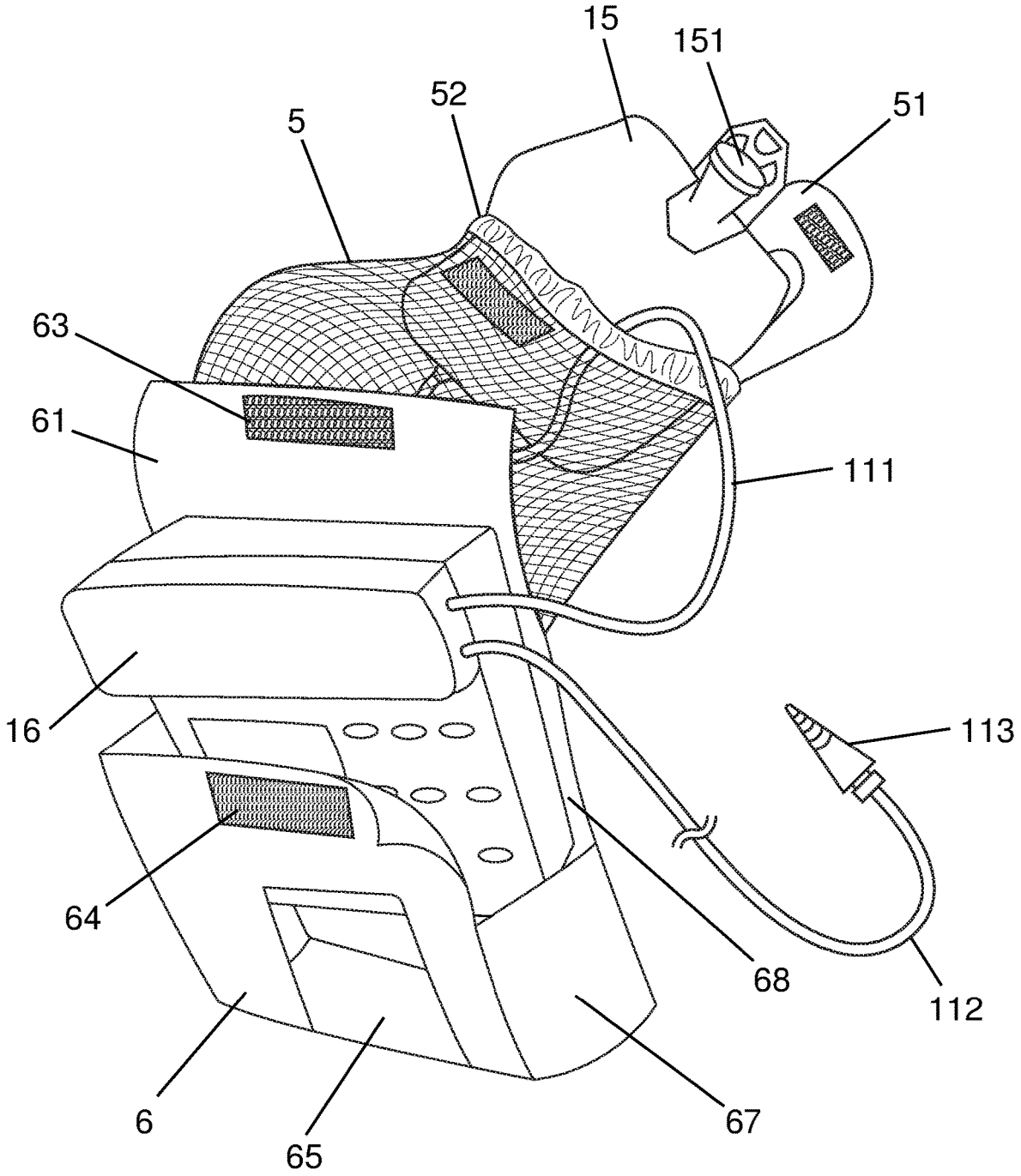
FIG. 18 is a rear perspective view of the milk pouch and pump pocket aspects of the present invention having a pump and milk container partially inserted into the respective receivers and tubing installed (strap components have been excluded from the illustration to expose detail of these features) and further illustrating some of the non-rigidity of the materials used in the present invention.
Figure 19:
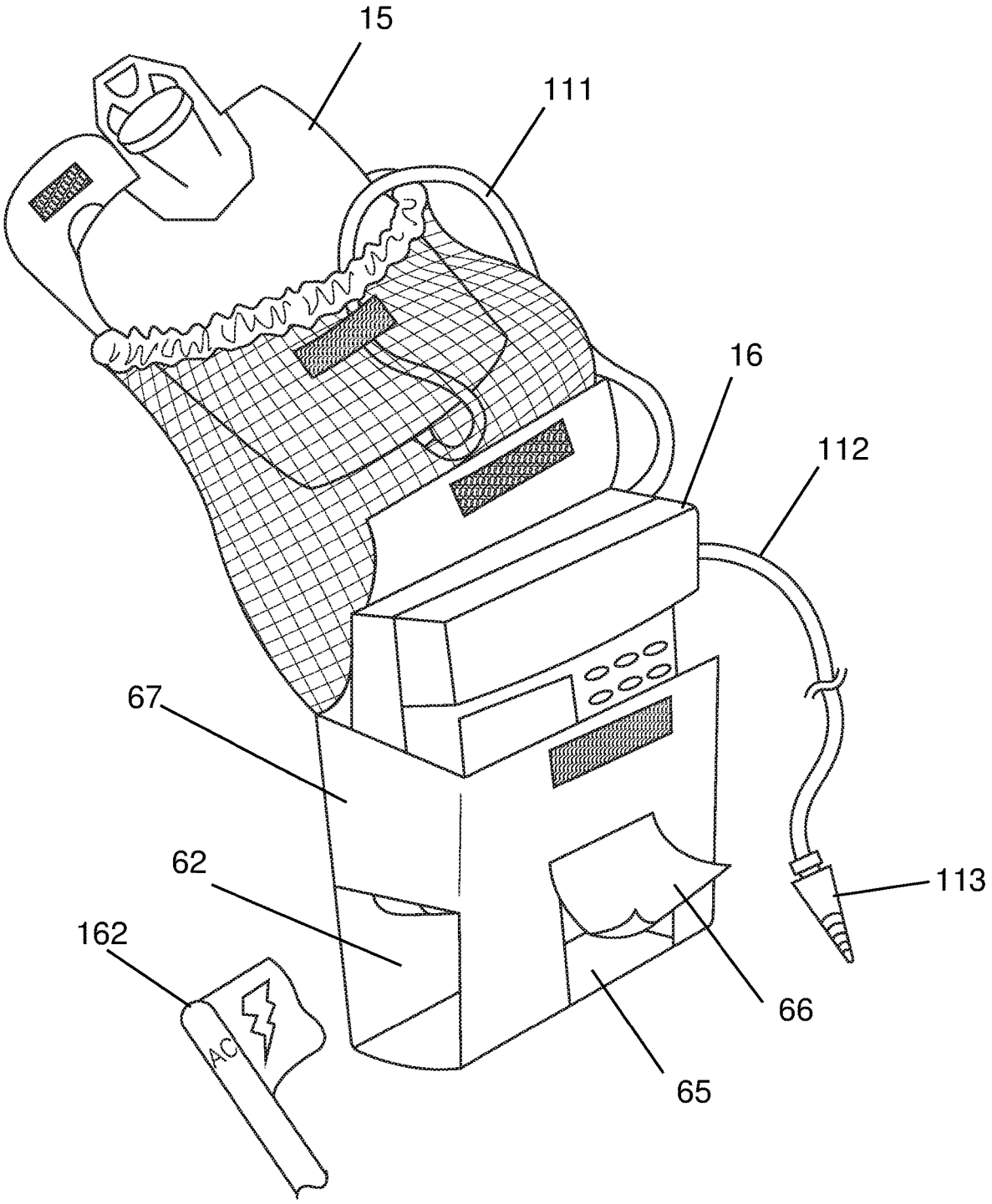
FIG. 19 is a rear perspective view of the milk pouch and pump pocket aspects of the present invention having a pump and milk container partially inserted into the respective receivers and tubing installed (strap components have been excluded from the illustration to expose detail of these features) and further illustrating the access port for the pump power cord and the pump display screen cover flap.

FIGS. 17-19 are representations of the invention with strap portions hidden in order to emphasize elements of the pouch-pocket aspects of the invention and how those elements cooperate with medical feeding apparatuses. In FIG. 17, the hanger 7, the tube retaining strap 8, the milk pouch 5 and the pump pocket 6 are illustrated. The milk pouch flap 51 is open showing the milk pouch elastic 52 and the first cooperating milk flap securing means 53 and the second cooperating milk flap securing means 54. In the preferred embodiment, the milk pouch 5 is constructed of utility mesh material with some flexibility and compressing ability which is gathered and sewn to match the shape of a full milk bag. The mesh material is also desirably see-through or sufficiently translucent or transparent to permit a caregiver to monitor the milk levels remaining in the milk bag 15. In FIG. 17, the pouch shows its expansion ability for receiving a milk bag 15. The mesh milk pouch 5 is gathered with elastic near the top (elastic portion 52) to secure the milk bag 15. The mesh milk pouch 5 is also gathered with stitching near the bottom to produce a convex shaping of milk pouch 5 to accommodate a full milk bag 15. The milk pouch flap 51 encircles the milk bag nozzle 151 (see FIGS. 1, 5 & 18) within the milk nozzle refill access hole 55 and this further secures the bag. Once closed over the milk bag nozzle 151, the milk pouch flap 51 is attached to the mesh body of the milk pouch 5 by the cooperating securing mechanism comprising a first part 53 and a second 54 and thus the flap secures the milk bag when the child is at play. In the preferred embodiment the coopering securing mechanism comprises a hook and loop fastener set, but similar closure mechanisms will meet the fastening objectives.

FIG. 17 illustrates the tube retainer 8 below the milk pouch 5 and atop the pump pocket 6. It is important for the tube retainer 8 location to be out of reach of the child but easily accessed and employed by a caregiver. The preferred material is elastic of sufficient tension to hold the tubing in place consistent with the manner illustrated but also loose enough to permit the unimpeded flow of milk through the tubing.

The pump pocket 6 is closed in FIG. 17 without a pump 16 inside. FIGS. 18-19 illustrates the pump pocket flap 61 open and a pump 16 partially inserting into the pump receiving sleeve 67 of the pump pocket 6. Once the pump 16 is inserted in the pocket 6, the pocket flap 61 will close over the top of the pump 16 and the first cooperating securing means 63 will cooperate with the second cooperating securing means 64. In the preferred embodiment the coopering securing mechanism comprises a hook and loop fastener set, but similar closure mechanisms will meet the fastening objectives. In the embodiment shown in FIGS. 17-18, the control panel cutout 65 is illustrated without a display flap cover 66 shown in FIG. 19.

FIG. 18 also illustrates the routing of a feeding tube when the present device is in use. A first section of the tube 111 is illustrated extending from the milk bag 15 out of the milk pouch 5 between the elastic 52 and the flap 51. The tube 11 enters the pump and leaves the pump as known in the art. The second section of the tube 112 extends from the pump to carry milk or other food to the child when the tube tip adaptor 113 is inserted into the stoma port 14 (see, e.g., FIG. 16). The tube access window 68 forms an opening in the pump pocket 6 to allow sufficient clearance for the tube 11 to enter and leave the pump pocket 6 unimpeded.

For the preferred embodiment of the present invention, a power cord access 62 (see FIGS. 17 & 19) provides a channel for the pump's power cord 162 to reach the pump 16 within the pump receiving sleeve 67. Pumps known in the market have an onboard battery supply to provide the pump power for portable use. However, those batteries must be periodically charged. The pump's electric charging cord 162 can be plugged into the pump electrical port 161 (visible e.g., FIGS. 1 and 5) of the pump 16 while the pump is inserted into the pump pocket 6. During preferred use, the pump 16 will be plugged in for recharging while the device 1 is hanging during nighttime feedings such as the illustration shown in FIG. 20.

In FIG. 19 the pump receiving pocket 67 shows a screen covering for the control panel cutout 65. The screen covering is formed of a control panel flap 66 which can be lifted for caregivers to monitor or adjust the pump 16, access control buttons and alarms, as well as review notifications or screen read outs. The control panel flap 66 is constructed of substantially or entirely opaque material for covering the display. It not only serves to hide the display for privacy but primarily serves to mute the light display of the pump's control panel. This feature will be particularly applicable when the device 1 is suspended from its hanger 7 while the child 10 is sleeping but still receiving feedings in a manner like that illustrated in FIG. 20. The hanger 7 will also be useful to a caregiver, for example, during travel, naps, diaper changes, and baths. The pump pocket 6 features may have many other variations in their construction and location of the access 62, tube access window opening 68, and screen cutout 65 and cover 66 depending on the model of pump 16 being accommodated. The illustrated embodiment will find particular application for the EnteraLite® pumps and slight alterations could easily accommodate pumps like the Kangaroo Joey™ pump or similar portable pumps.

Figure 20:
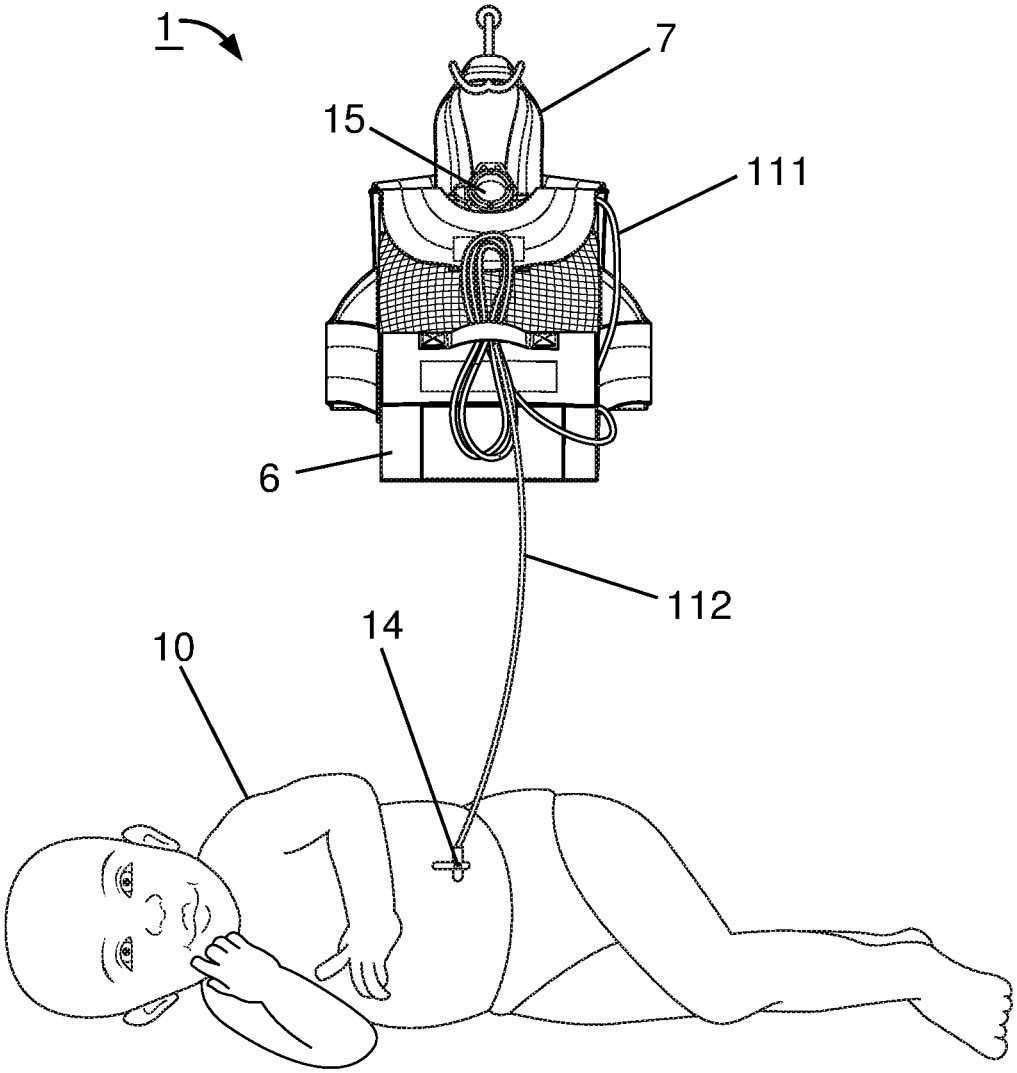
FIG. 20 is an illustration of a small child lying on his side and showing a rear view of the present invention in a closed configuration hanging by its hanger from a hook while the child sleeps and receives nutrients through the feeding tube during nighttime feedings.

In FIG. 20, the child 10 is lying on his side receiving continuous feedings through the tube 11 which is carrying milk from the milk bag 15 via the first section of the tube 111 through the pump in the pump pocket 6 and out through the second section of tube 112 to the stoma port 14. The device 1 is displayed as hanging from a wall mount, however, the looped top strap for hanging the carrying pack can be suspended from other nearby locations such as IV pole or bed post. A parent can replace the milk bag 15 or simply refill the formula or nutrients through the milk nozzle 151 as it hangs from the device hanger 7 without disturbing the child 10. In fact, refills can also be done while the device is worn by the child. The unique features of the full access to the milk bag nozzle and all pump controls reduces the need to make any Velcro®-related noise and risk disrupting a child, particularly during sleep.

The present invention is directed to use by children, specifically up to 7 years; however, it will find application and utility for enteral feeding tube patients of all ages. Herein, milk has been repeatedly referenced but is hereby defined to include any and all nutrition, formula, medication, water or other substance in the generic which may be delivered to a human through a medical tube.

As with all medically employed implements, cleanliness is a must. The device straps are desirably constructed of nylon, nylon ripstop material, or other natural or synthetic blends of these or similar non-stretchy materials which are not rigid but also not inflexible. The preferred material will be wear and tear resistant and stain-resistant and allow spot cleaning or laundering of the device to allow repeated and ongoing use. The preferred material must also be soft for comfort, particularly around the neck area, and also breathable for dissipating heat and sweat, all in order to avoid skin irritation. The material must be flexible for comfort and conformability but must also be able to hold its shape without stretching. The material of construction will ideally not absorb diaper blowouts or spillage but allow easy clean up. Components such as the pump pocket 6 have more flexibility in selection of materials so long as it can be laundered and allow the small amount of heat from the pump 16 to dissipate, which is aided by the power access 62 and tube access window 68. The hanger 7 should be constructed of a sturdy material which can hold the weight of the device 1 when all enteral feeding inserts are included.

Each time a hook and loop pair of patches is illustrated, the hook and loop arrangement could be reversed providing that no contact is made with the child's skin that would cause irritation to the child or be arranged in such a way to cause irritation to the caregiver. Additionally, although hook and loop fastening means are disclosed and illustrated, similar closure mechanisms that will reliably but removably secure two components together may be employed as a replacement so long as the other objectives of the invention are satisfied.

It is further intended that any other embodiments of the present invention which result from any changes in application or method of use or operation, method of manufacture, shape, size, or material which are not specified within the detailed written description or illustrations contained herein, yet are considered apparent or obvious to one skilled in the art, are within the scope of the present invention.

I claim:

1. An improved enteral feeding tube, milk bag and pump carrying device comprising:

a milk bag pouch having a cover flap with a refill access hole covering an elastic opening to the milk bag pouch, the cover flap having a fastener to cooperate with a fastening mechanism on the milk bag pouch to close the cover flap over the milk bag pouch while retaining an access wherethrough a nozzle of the milk bag may protrude through the refill access hole, a pump pocket disposed below the milk bag pouch having a pump receiving sleeve closed by a pocket flap wherein a sleeve fastener cooperates with a pocket flap fastening mechanism to secure the pump, the pump pocket having voids to accommodate the pump including a power cord access, a control panel cutout, and a tube access aperture, an elastic tube retainer for receiving slack of the enteral feeding tube, a hanger atop the device, a vestpack configured to mount the milk bag pouch and the pump pocket onto a child's back, the vestpack having more than one interior-facing fasteners, and a chest panel system, the chest panel system having an exterior-facing chest panel fastener configured to cooperate with the more than one interior-facing fasteners.

2. The improved carrying device of claim 1, wherein the vestpack further comprises:

a right shoulder strap having a right shoulder (RS) fastener, a left shoulder strap having a left shoulder (LS) fastener, a right underarm strap having a right underarm (RU) fastener and a first interior-facing fastener, a left underarm strap having a left underarm (LU) fastener and a second interior-facing fastener, wherein the RS fastener cooperates with the RU fastener and the LS fastener cooperates with the LU fastener.

3. The improved carrying device of claim 2, the chest panel system further comprising an extender having a third interior-facing fastener opposite an exterior-facing extender fastener such that the first or second interior-facing fastener cooperates with the exterior-facing extender fastener while the third interior-facing fastener cooperates with the exterior-facing chest panel fastener.

4. The improved carrying device of claim 3, wherein the first, second, and third interior-facing fasteners are comprised of loops.

5. The improved carrying device of claim 3, wherein the exterior-facing extender fastener and exterior-facing chest panel fastener are comprised of hooks.

6. The improved carrying device of claim 1, wherein the pump pocket further comprises a control panel flap.

7. The improved carrying device of claim 1, the elastic tube retainer being spaced below the milk bag pouch and above the pump pocket.

8. The improved carrying device of claim 1, wherein the milk bag pouch is constructed of compressing mesh material.

9. The improved carrying device of claim 1, wherein the hanger may be stowed around the nozzle of the milk bag.

10. An improved enteral feeding tube, milk bag and pump carrying device comprising:

a backpack having a milk bag pouch oriented atop of the backpack, the backpack further having a pump pocket disposed below the milk bag pouch, the milk bag pouch constructed of compressible mesh and having an elastic top-opening, the elastic top-opening having a cover flap with a refill access hole, the cover flap further having a fastener to cooperate with a fastening mechanism on the compressible mesh to close the cover flap over the milk bag pouch while retaining an access wherethrough a nozzle of the milk bag may protrude through the refill access hole, the pump pocket having a receiving sleeve sewn to custom fit the pump, the receiving sleeve closed by a pocket flap wherein a sleeve fastener cooperates with a pocket flap fastening mechanism to secure the pump, the pump pocket further having access apertures to accommodate the pump including a power cord access, a control panel cutout, a cover for the control panel cutout, and a non-threading feeding tube access, an elastic tube retainer for looping slack of the enteral feeding tube on the backpack, a hanger disposed near the milk pouch, a strap configuration formed to fit a child and having receiving fasteners, a chest panel system having an exterior-facing chest panel fastener which cooperates with the receiving fasteners, the chest panel system further comprising an extender with additional fasteners configured to cooperate with the exterior-facing chest panel fastener, the extender further comprising an exterior-facing extender fastener to cooperate with the receiving fasteners.

11. The improved carrying device of claim 10, wherein the strap configuration further comprises:

a right shoulder strap having a right shoulder (RS) fastener, a left shoulder strap having a left shoulder (LS) fastener, a right underarm strap having a right underarm (RU) fastener and a first interior-facing fastener, a left underarm strap having a left underarm (LU) fastener and a second interior-facing fastener, wherein the RS fastener cooperates with the RU fastener and the LS fastener cooperates with the LU fastener.

12. The improved carrying device of claim 11, wherein the first interior-facing fasteners, second interior-facing fasteners, and the additional fasteners of the extender are comprised of loops.

13. The improved carrying device of claim 11, wherein the exterior-facing extender fastener and exterior-facing chest panel fastener are comprised of hooks.

14. The improved carrying device of claim 10, wherein the strap configuration and the chest panel system permit custom rise and girth fitting to the child without hindering mobility.

* * * * *